US008475126B2

(12) United States Patent
Yoshida et al.

(10) Patent No.: US 8,475,126 B2
(45) Date of Patent: Jul. 2, 2013

(54) HOUSING ASSEMBLY FOR USE IN FAN UNIT AND FAN UNIT INCLUDING THE SAME

(75) Inventors: Yusuke Yoshida, Kyoto (JP); Takahiro Kikuichi, Kyoto (JP); Masayuki Yamada, Kyoto (JP)

(73) Assignee: Nidec Corporation, Kyoto (JP)

( * ) Notice: Subject to any disclaimer, the term of this patent is extended or adjusted under 35 U.S.C. 154(b) by 1315 days.

(21) Appl. No.: 12/237,495

(22) Filed: Sep. 25, 2008

(65) Prior Publication Data

US 2009/0022587 A1 Jan. 22, 2009

Related U.S. Application Data

(63) Continuation-in-part of application No. 10/908,582, filed on May 18, 2005, now Pat. No. 7,654,792.

(30) Foreign Application Priority Data

May 18, 2004 (JP) ..... 2004-147661
May 9, 2005 (JP) ..... 2005-135624

(51) Int. Cl.
*F04D 19/02* (2006.01)
*F04D 29/52* (2006.01)
*F04D 29/64* (2006.01)

(52) U.S. Cl.
USPC ..... 415/214.1; 415/68

(58) Field of Classification Search
USPC ..... 361/695; 415/66, 68, 198.1, 199.4, 415/208.1, 211.2, 213.1, 214.1
See application file for complete search history.

(56) References Cited

U.S. PATENT DOCUMENTS 5,498,130 A * 3/1996 Wakley et al. ..... 415/213.1
6,067,227 A * 5/2000 Katsui et al. ..... 361/695
6,071,078 A * 6/2000 Schlegel et al. ..... 416/247 R
6,612,817 B2 * 9/2003 Lin et al. ..... 417/423.5
7,156,611 B2 * 1/2007 Oosawa et al. ..... 415/68

OTHER PUBLICATIONS

Kikuichi et al.; "Blower"; U.S. Appl. No. 10/908,582, filed May 18, 2005.

* cited by examiner

*Primary Examiner* — Nathaniel Wiehe
*Assistant Examiner* — Sean J Younger
(74) *Attorney, Agent, or Firm* — Keating & Bennett, LLP

(57) ABSTRACT

A housing assembly for a fan unit includes an upper housing having a lower engaging portion adjacent to its lower end surface and a lower housing having an upper engaging portion adjacent to its upper end surface. When one of the upper and lower housings rotates relative to the other about a center axis of the housings in a first direction with the opposing end surfaces of the housings in axial contact, the lower and upper engaging portions engage with each other. While the lower and upper engaging portions are in engagement, one of the lower and upper engaging portions presses the other in both axial directions to cause elastic axial deformation of the other; and one of the lower and upper engaging portions presses the other toward both the first direction and a second direction opposite thereto to cause elastic circumferential deformation of the other.

13 Claims, 20 Drawing Sheets

HOUSING ASSEMBLY FOR USE IN FAN UNIT AND FAN UNIT INCLUDING THE SAME

CROSS REFERENCE TO RELATED APPLICATIONS

This is a Continuation-In-Part application of co-pending U.S. patent application Ser. No. 10/908,582 filed on May 18, 2005, pending, which in turn claims priority from Japanese Patent Application No. 2004-147661 filed on May 18, 2004 and Japanese Patent Application No. 2005-135624 filed on May 9, 2005, both of which are hereby incorporated by reference in their entirety.

BACKGROUND OF THE INVENTION

1. Field of the Invention

The present invention relates to a fan unit including a housing assembly which has a plurality of housings connected to or engaged with each other, and to the housing assembly of the fan unit.

2. Description of the Related Art

In order to improve the high capacity of an air flow and a static pressure generated by a fan without increasing the impeller diameter, a fan unit called "a double fan" is widely used in which a plurality of axial fans are arranged along the rotational axis thereof. Also, another type of fan unit is used which uses centrifugal fans connected in series with a direction in which the air is blown so as to provide a high static pressure.

In an exemplary known fan unit having a plurality of fan impellers, two or more impellers are encased in a single housing or each impeller is encased in each housing, and the housings are connected with each adjoining housing in an axial direction substantially parallel to the rotational axes thereof. Generally, a high development cost is required to design a new fan unit including the design of its housing. Therefore, one way for achieving a cost reduction is to connect or engage a plurality of existing axial fans or centrifugal fans, which meets the performance requested for the new fan unit.

There are two major ways to connect or engage two or more adjoining housings. One way is that flanges of the housings are fixedly coupled to each other by screws, and the other is that elastic hooks formed on one housing are engaged with recesses of the other housing.

In the case where the fans are fixedly connected by screws, however, a special tool such as a screwdriver or wrench may be required. This increases the number of steps for connecting the fans as well as the number of parts of the fan unit, thereby the cost for producing the fan unit may increase because of the complex structure of the fan unit. In connecting the adjoining fans by elastic hooks, on the other hand, since the elastic hooks can be formed at the same time as the housing is formed by a molding process, the cost for the housing with such elastic hooks does not necessarily increase. Also, the elastic hooks can be engaged very simply without increasing the number of steps for engaging the housings.

However, when the connection by elastic hooks is performed, there are two requirements competing with each other. One requirement is to provide a sufficient elasticity for elastic deformation which may be required for engaging the two adjoining fans, and the other requirement is to provide a sufficient engaging force. Specifically, in the case where the elasticity of the elastic hooks is increased to achieve an easier engaging step, the engaging force decreases and an insufficient engaging force may occur. On the other hand, in the case where the elasticity of the elastic hooks is decreased, the engaging force increases but the engaging step becomes difficult because the elastic hooks may be damaged or the housing may be warped.

That is, it is difficult to provide the elastic hooks with an appropriate level of elasticity in the case of using elastic hooks, even though the use of elastic hooks appears to be simple.

SUMMARY OF THE INVENTION

According to preferred embodiments of the present invention, a housing assembly for use in a fan unit is provided. The housing assembly includes an upper housing and a lower housing which are coaxially coupled to each other to define a substantially cylindrical space for accommodating at least a plurality of blades therein. The upper housing has a lower end surface and a lower engaging portion adjacent thereto. The lower housing has an upper end surface and an upper engaging portion adjacent thereto.

The lower and upper engaging portions are arranged to engage with each other to couple the upper and lower housings to each other by rotating one of the upper and lower housings about a center axis of the upper and lower housings relative to the other in a first direction (Rd) with the lower end surface of the upper housing in axial contact with the upper end surface of the lower housing.

When the lower and upper engaging portions are in engagement, one of the lower and upper engaging portions presses the other in both axial directions to cause elastic axial deformation of the other, and one of the lower and upper engaging portions presses the other toward both the first direction and a second direction opposite thereto to cause elastic circumferential deformation of the other.

Other features, elements, steps, advantages and characteristics of the present invention will become more apparent from the following detailed description of preferred embodiments thereof with reference to the attached drawings.

DETAILED DESCRIPTION OF PREFERRED EMBODIMENTS

Figure 1A:
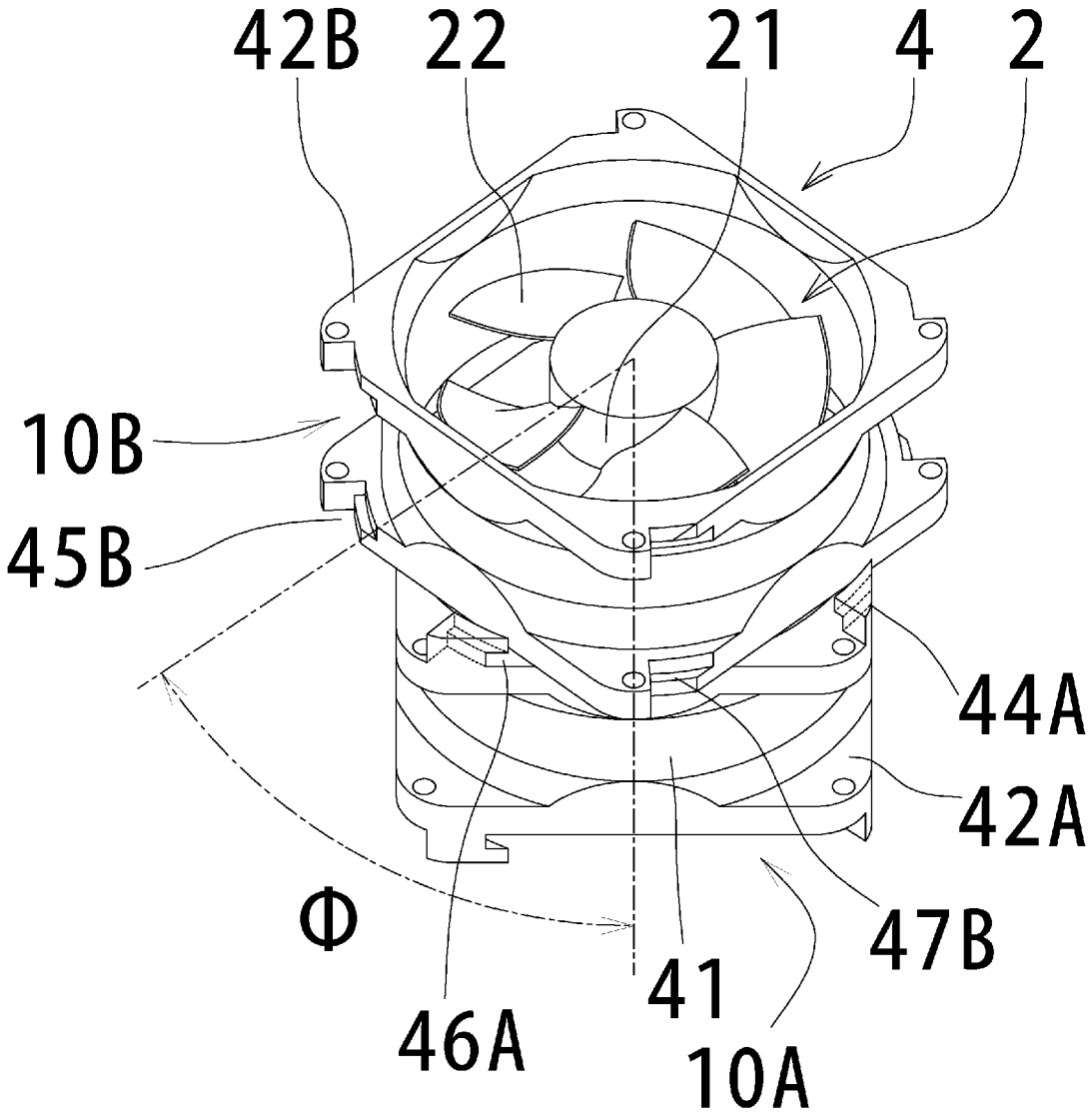
FIGS. 1A, 1B, and 1C are perspective views of a fan unit according to a first preferred embodiment of the present invention.

Referring to FIGS. 1A through 11, preferred embodiments of the present invention will be described. In the following description, each of the four directions is indicated as viewed on the drawings unless otherwise specified, and not specifically limited in embodying the preferred embodiments of the present invention. Also, the uppercase suffixes A through J attached to the reference numerals in the description and drawings designate the components of axial fans 10A through 10J, respectively. The components carrying no uppercase suffix designate common or independent parts having similar functions.

First Preferred Embodiment

Figure 1B:
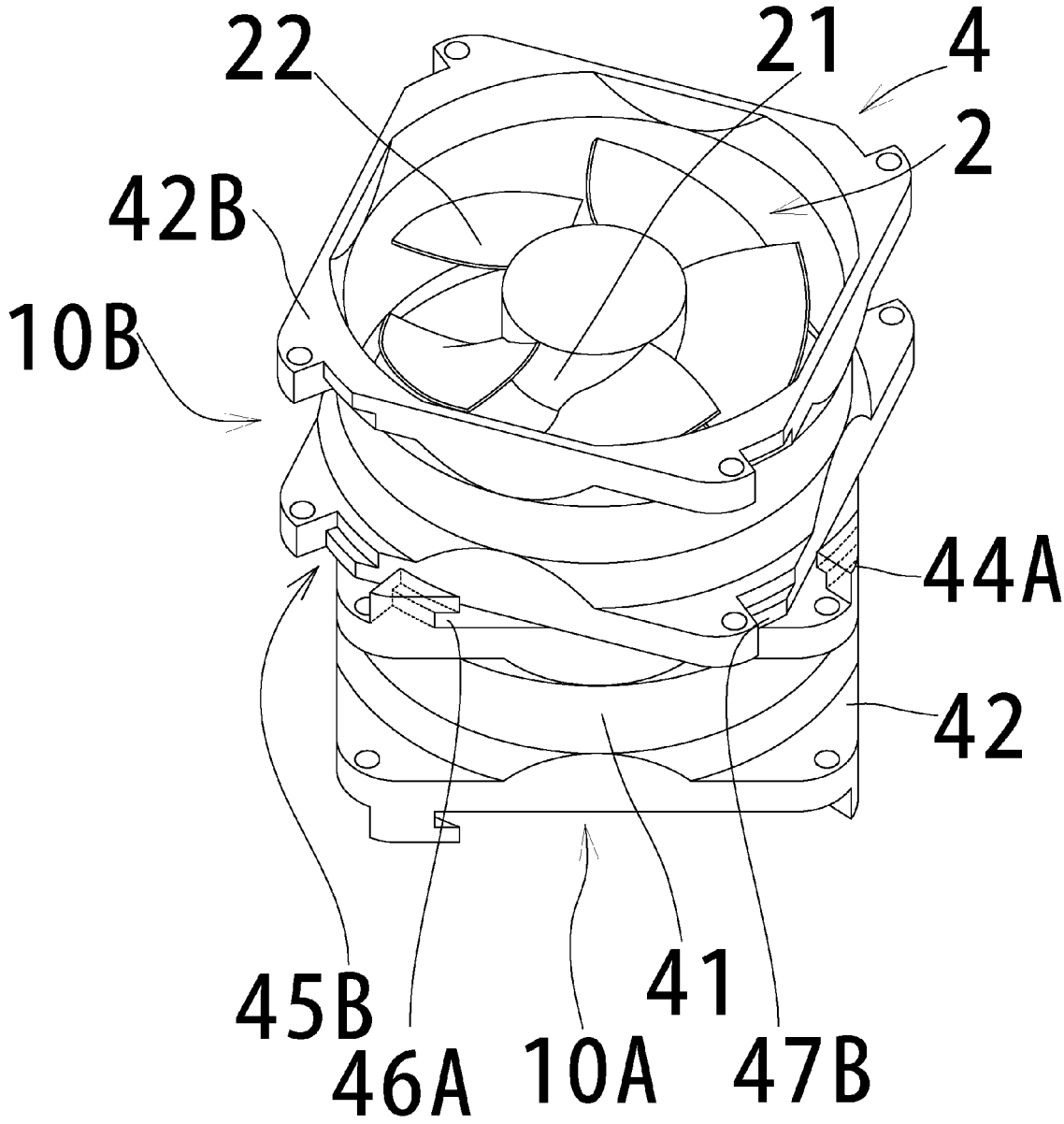
Figure 1C:
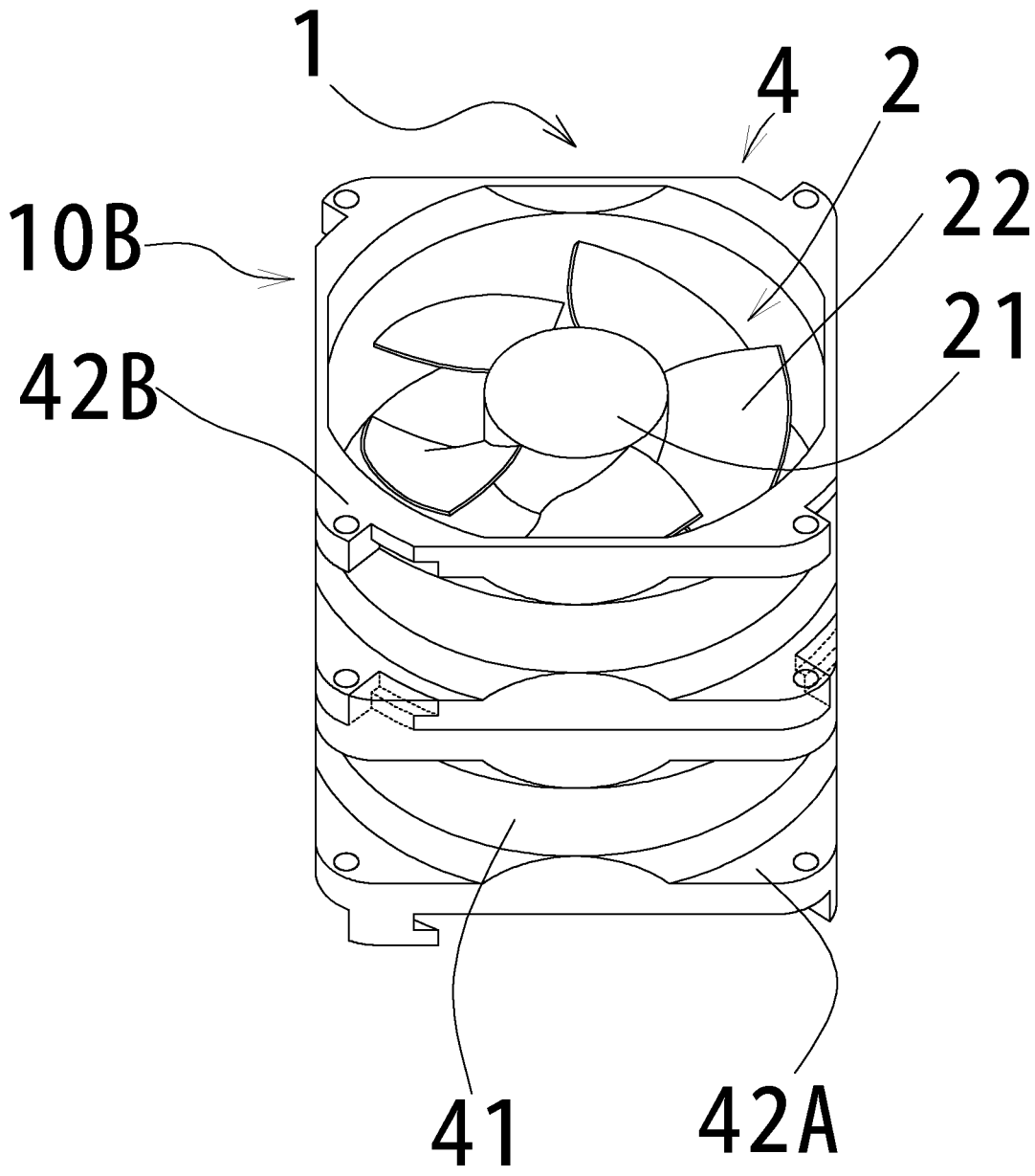
Figure 2A:
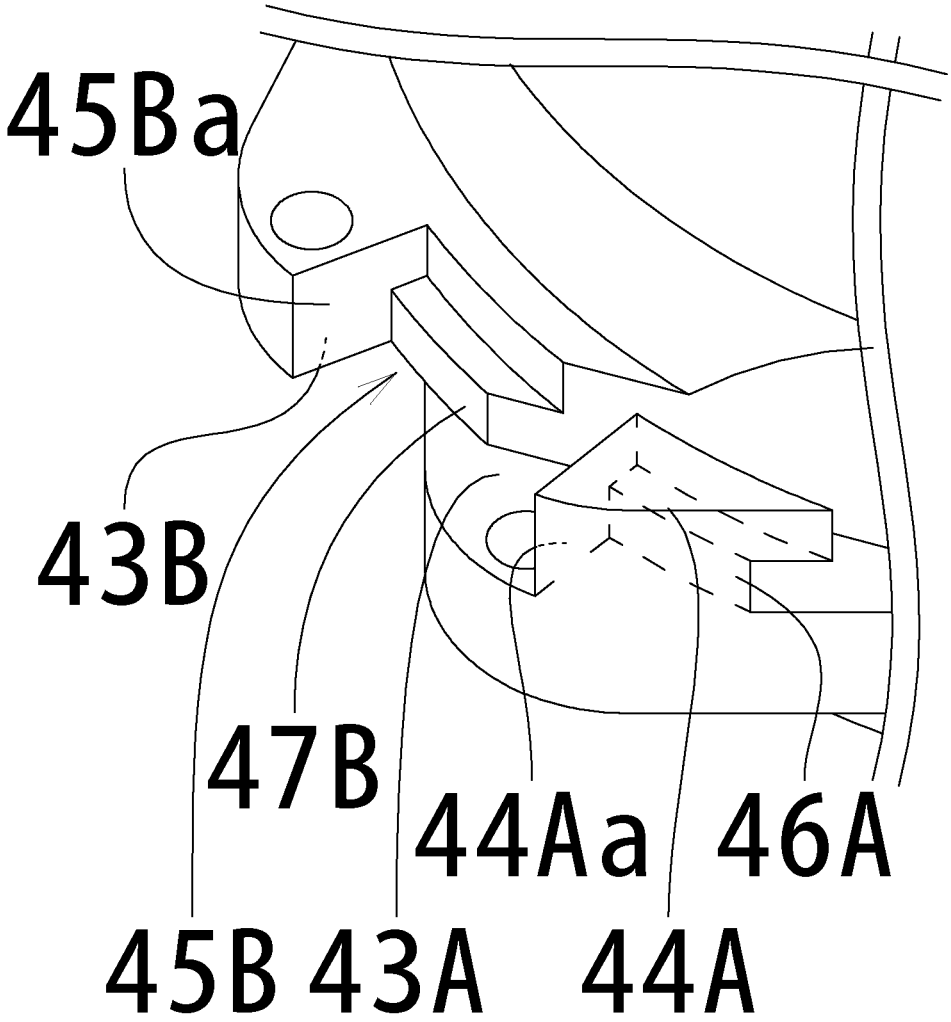
FIGS. 2A and 2B are enlarged views of the coupling structure of the fan unit according to the first preferred embodiment of the present invention.
Figure 2B:
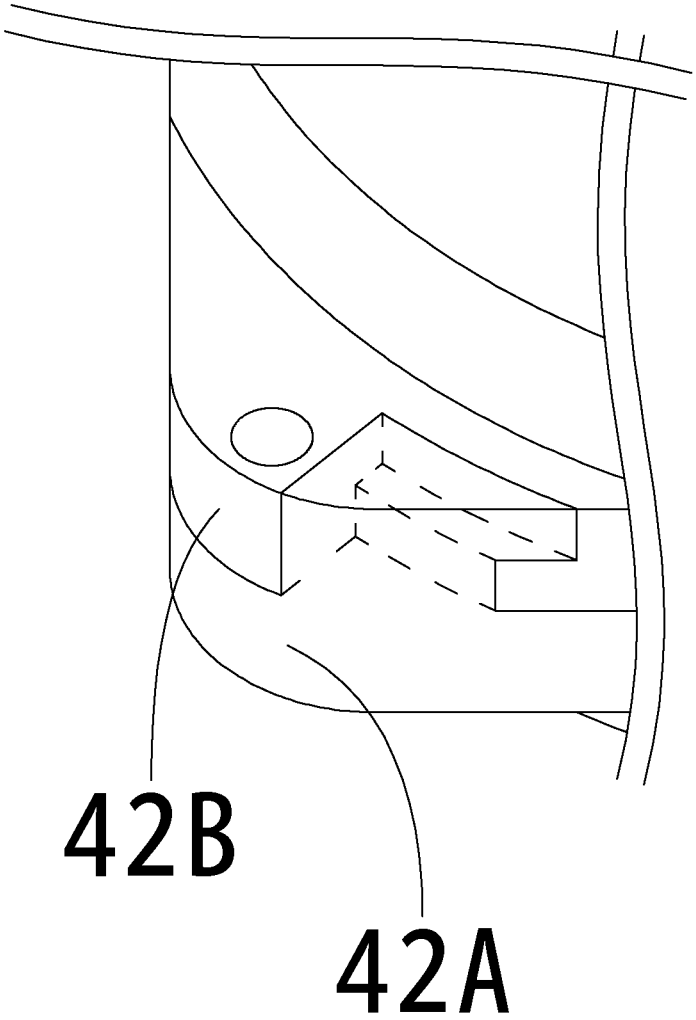
Figure 3A:
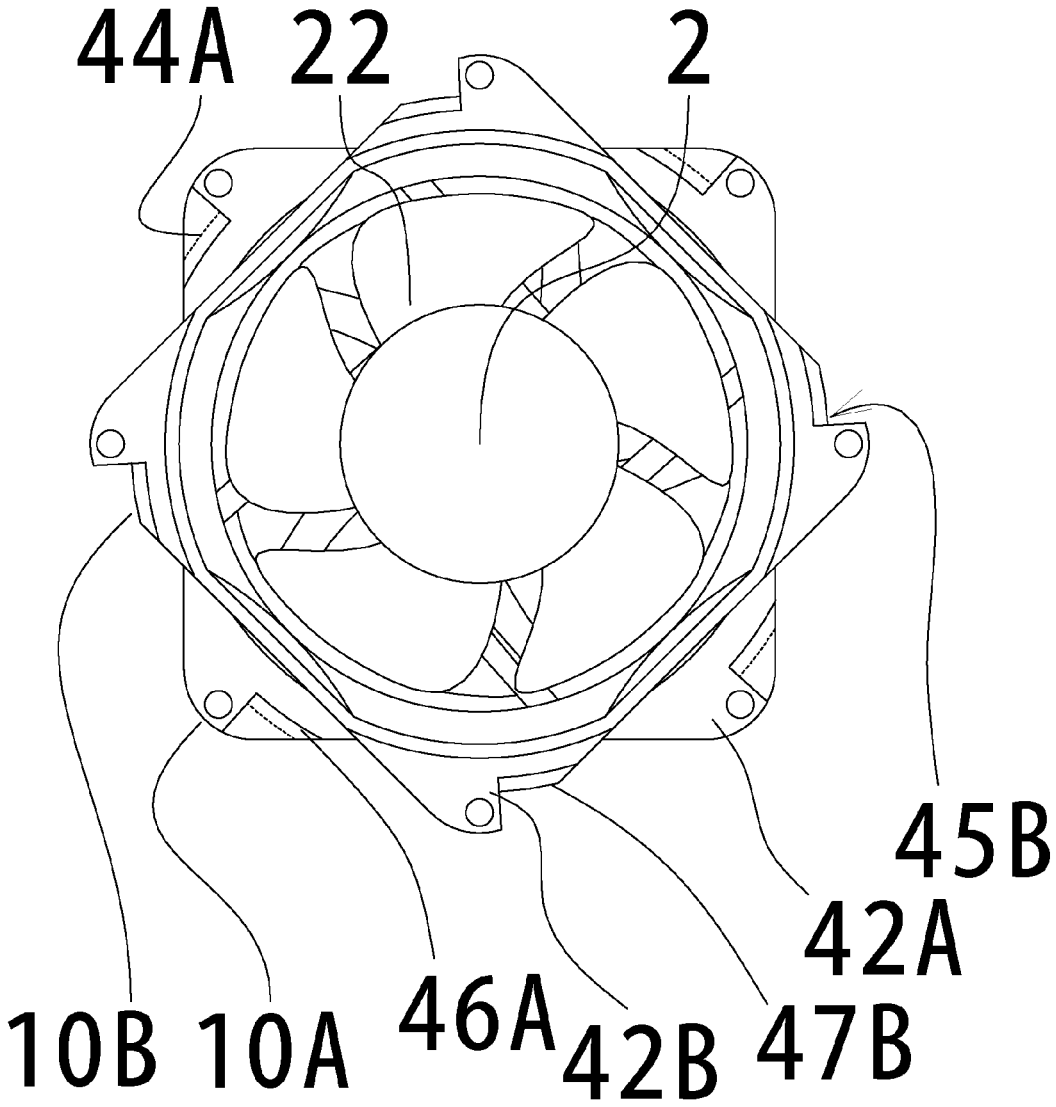
FIGS. 3A, 3B, and 3C are top views of the fan unit according to the first preferred embodiment of the present invention.
Figure 3B:
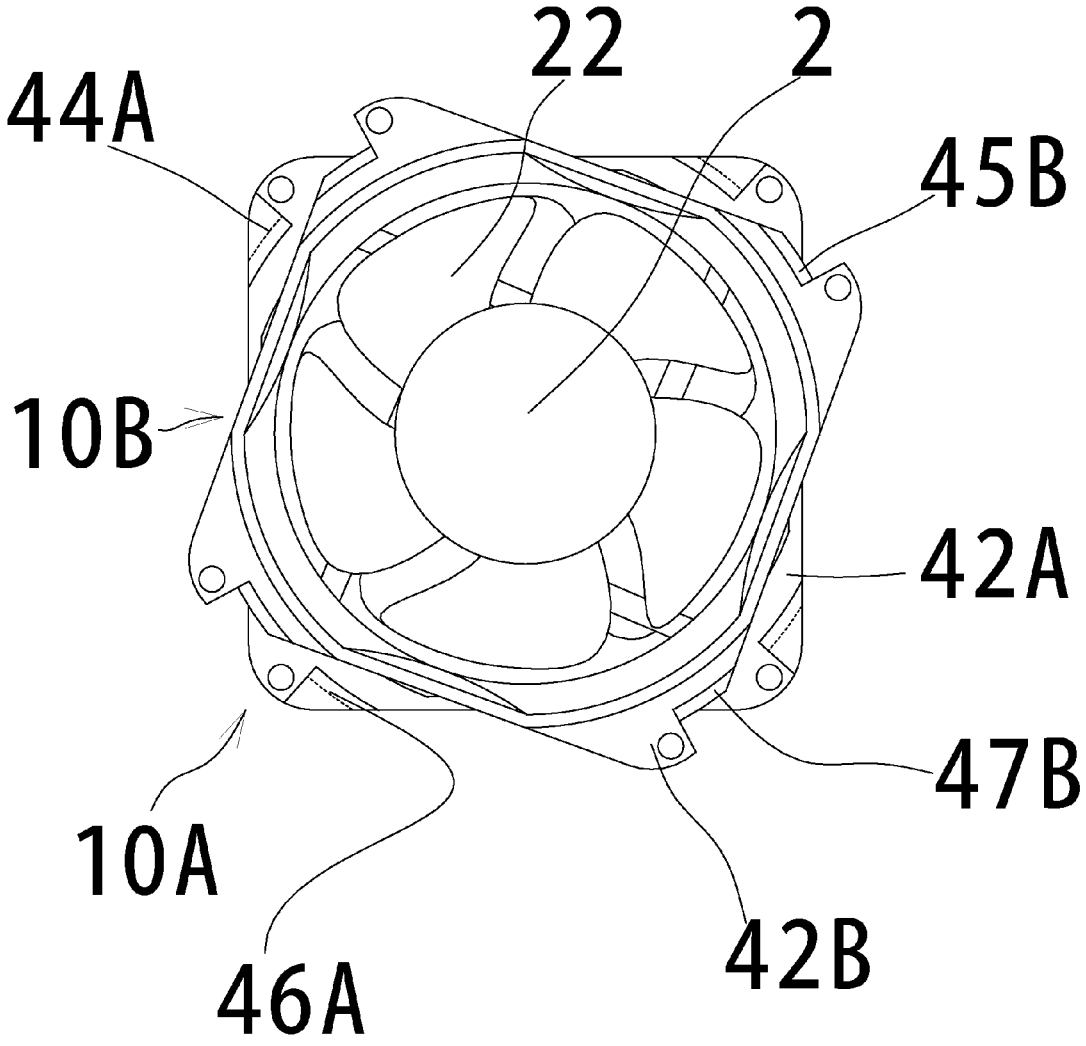
Figure 3C:
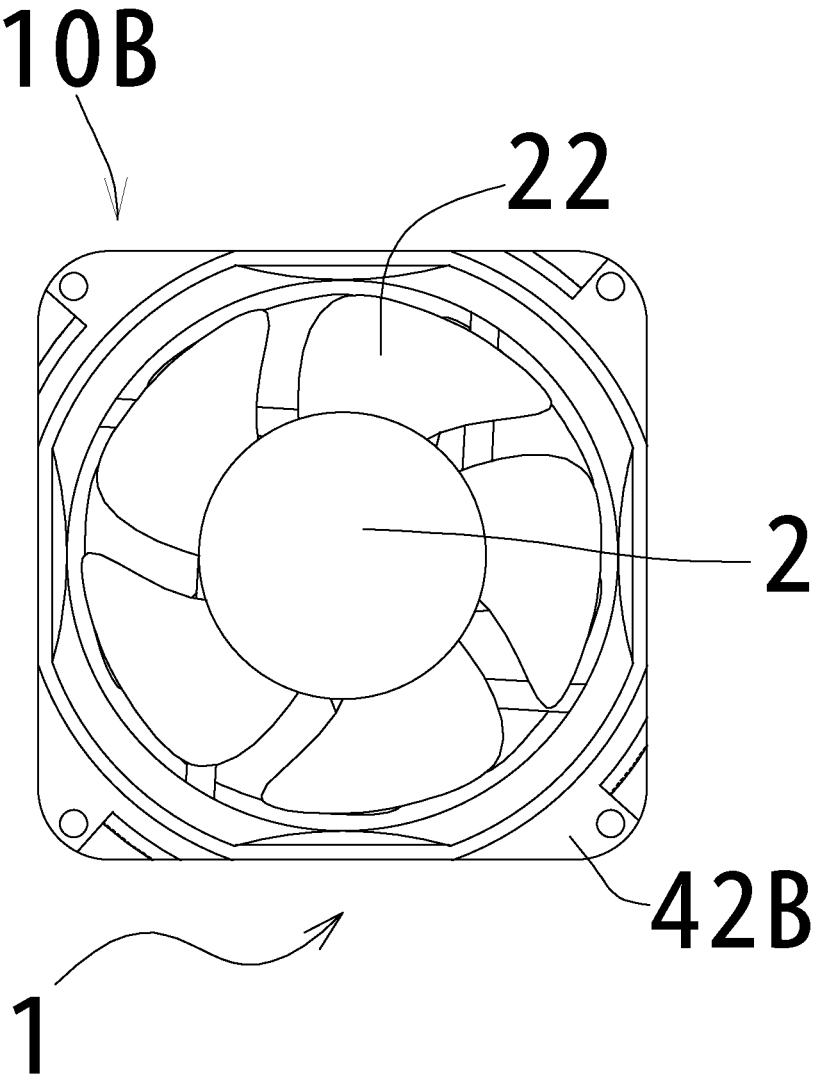

FIGS. 1A, 1B, and 1C are perspective views of a fan unit according to a first preferred embodiment of the present invention. Specifically, FIG. 1C shows the fan unit 1 of the present preferred embodiment assembled by coupling two axial fans 10A, 10B, and FIGS. 1A and 1B show the states before being coupled. FIGS. 2A and 2B are enlarged views of the coupling structure of the fan unit of the present preferred embodiment. FIGS. 3A, 3B, and 3C are top views of the fan unit of the present preferred embodiment.

Configuration of the Fan Unit

Referring to FIGS. 1A, 1B, and 1C, the fan unit 1 includes two axial fans 10A and 10B coupled to each other in series in an axial direction substantially parallel to their rotational axes.

The axial fans 10A, 10B each include a substantially cylindrical peripheral wall 21 and an impeller 2 having a plurality of blades 22 regularly arranged on the outer peripheral surface of the peripheral wall 21.

The axial fans 10A, 10B each include a housing 4 with a cylindrical portion 41 having a cylindrical inner side surface larger in diameter than the radial outer edge of the blades 22 and concentric with the rotational axis of the impeller 2.

Further, an electric motor (not shown) arranged to rotate the impeller 2 relative to the housing 4 is mounted on the housing 4. The electric motor is preferably a DC brushless motor including a shaft fixed at the rotational center of the impeller 2, a bearing arranged to support the shaft so that the shaft can rotate, a bearing holder supporting the bearing on the housing 4, a stator including a plurality of coil windings fixed on the outer periphery of the bearing holder, and a rotor magnet fitted on the inner side surface of the peripheral wall 21 of the impeller 2.

The axial fans 10A, 10B can be used independently of each other. In the present preferred embodiment, the lower axial fan 10A arranged on the axially lower side is combined with the upper axial fan 10B arranged on the axially upper side.

Housing of the Axial Fans

The ends of the cylindrical portion 41 of the axial fan 10A are open in the axial direction, and a plurality of flanges 42A are arranged radially outward of at least the end of the cylindrical portion 41 in opposed relation to the flanges 42B of the axial fan 10B. The flanges 42A are preferably arranged at four locations at 90° intervals around the center axis of the cylindrical portion 41, for example. The edges of the flanges 42A preferably define angles of 90° so that the flanges 42A as a whole substantially assume the shape of a square or substantially a square. The axial fans 10A and 10B, when arranged serially along the axis, have the flanges 42A and 42B aligned with each other in the axial direction.

By forming the flanges 42A and 42B of the axial fans 10A and 10B in the same shape as shown in FIGS. 3A, 3B, and 3C, the fan unit 1 can have the same planar shape as the axial fans 10A and 10B.

Before combining the axial fans 10A and 10B, the rotational axis of the impeller is displaced by an angle $\phi$ from the center axis of the impeller. Also, the angle is zero in the case where the axial fan 10A is rotated with the contour thereof into alignment with that of the axial fan 10B, i.e., in the case where the axial fans 10A and 10B share the same planar shape.

Flanges

Referring to FIGS. 2A and 2B, the surface of the flanges 42A of the axial fan 10A, which is in contact with the flanges 42B of the axial fan 10B, defines a flat housing portion 43A substantially perpendicular to the rotational axis of the impeller 2. Similarly, the surface of the flanges 42B of the axial fan 10B, which is in contact with the flanges 42A of the axial fan 10A, defines a flat housing proton 43B substantially perpendicular to the rotational axis of the impeller 2. The flat housing portion 43A of the axial fan 10A and the flat housing portion 43B of the axial fan 10B are in slidable contact with each other, and function as housing engaging portions.

Each flange 42A has a protrusion 44A functioning as a housing stopper on the flat housing portion 43A thereof in opposed relation to the flat housing portion 43B. The protrusion 44A is provided with a radial recess 46A functioning as a housing engaging portion. Also, each flange 42B is provided with a notch 45B cut into the flat housing portion 43B which functions as a stopper corresponding to the protrusion 44A. Further, the notch 45B is provided with a radial protrusion 47B providing a housing engaging portion and has a shape so as to closely engage the radial recess 46A.

The protrusion 44A and the notch 45B are shaped so as to complement each other. Once the flat housing portion 43A and the flat housing portion 43B are rotationally slid to reduce the angle $\phi$ around the rotational axis of the impeller to zero, the radial protrusions 47B are fitted, under light pressure, into the radial recesses 46A located at four points, respectively, so that each notch 45B and the corresponding protrusion 44A are fitted closely with each other.

More specifically, each protrusion 44A is provided with the radial recess 46A along a peripheral direction around the rotational axis. In the radial recess 46A, the protrusion 44A is cut into one-half of the height of the protrusion 44A from the flat housing portion 43A, and the peripheral and inner ends thereof are open. The protrusion 44A has the same height as the thickness of the flange 42B. Each notch 45B is has the same shape as the protrusion 44A. Further, the radial protrusion 47B in the shape corresponding to the radial recess 46A is arranged around the rotational axis within the notch 45B. The radial protrusion 47B preferably is about one-half as thick as the flange 42B, and preferably has substantially the same radial thickness as the radial recess 46A. The height and the radial thickness of the radial recess 46A are equal to or slightly smaller than the height and the radial thickness, respectively, of the radial protrusion 47B.

The engagement between the radial recess 46A and the radial protrusion 47B defining the engaging portions restricts the axial movement of the axial fans 10A and 10B. Also, the friction generated by the contact between the protrusion 44A including the radial recess 46A and the notch 45B including the radial protrusion 47B restricts the peripheral movement of the axial fans 10A and 10B. Further, the flat surface 44Aa providing lower a flat stopper surface extending at substantially right angles to the peripheral direction of the protrusion 44A and to the flat housing portion 43A comes into contact with the flat surface 45Ba providing an upper flat stopper surface formed at substantially right angles to the peripheral direction of the notch 45B and to the flat housing portion 43B, so that the axial fans 10A and 10B are peripherally set in position.

The steps of fitting the axial fans 10A and 10B are described below.

First, as shown in FIGS. 1A and 3A, the flat housing portion 43A of each flange 42A of the axial fan 10A and the corresponding flat housing portion 43B of the flange 42B of the axial fan 10B are brought into contact with each other. Next, the axial fan 10B is rotated in a counterclockwise direction, as taken in the plan view of FIG. 3A, around the rotational axis of the impeller with respect to the axial fan 10A. As a result of this process, the radial protrusion 47B is fitted in the corresponding radial recess 46A. Finally, the axial fan 10B is rotationally slid until the flat surface 44Aa and the flat surface 45Ba come into contact with each other. As a result of this process, as shown in FIGS. 1C and 3C, the flanges 42A and 42B come into alignment with each other thereby to complete the fan unit 1.

The axial fans 10A and 10B are peripherally set in position by the contact between the flat surface 44Aa of the protrusion 44A and the flat surface 45Ba of the notch 45B and the resulting restriction of rotation of the axial fan 10A with respect to the axial fan 10B.

Incidentally, the radial protrusion 47B may be arranged on the protrusion 44A. In such a case, however, the radial recess 46A is arranged in the notch 45B.

In the present preferred embodiment, even after assembling the axial fan 10A on the axial fan 10B, the assembly can be disassembled by being rotationally slid in the opposite direction (clockwise) to the fitting direction. In other words, the axial fans 10A, 10B can be used independently of each other. As a result, the axial fans 10A, 10B each can be used as a standard axial fan, and without any design change, assembled into and used in the fan unit 1.

Figure 5A:
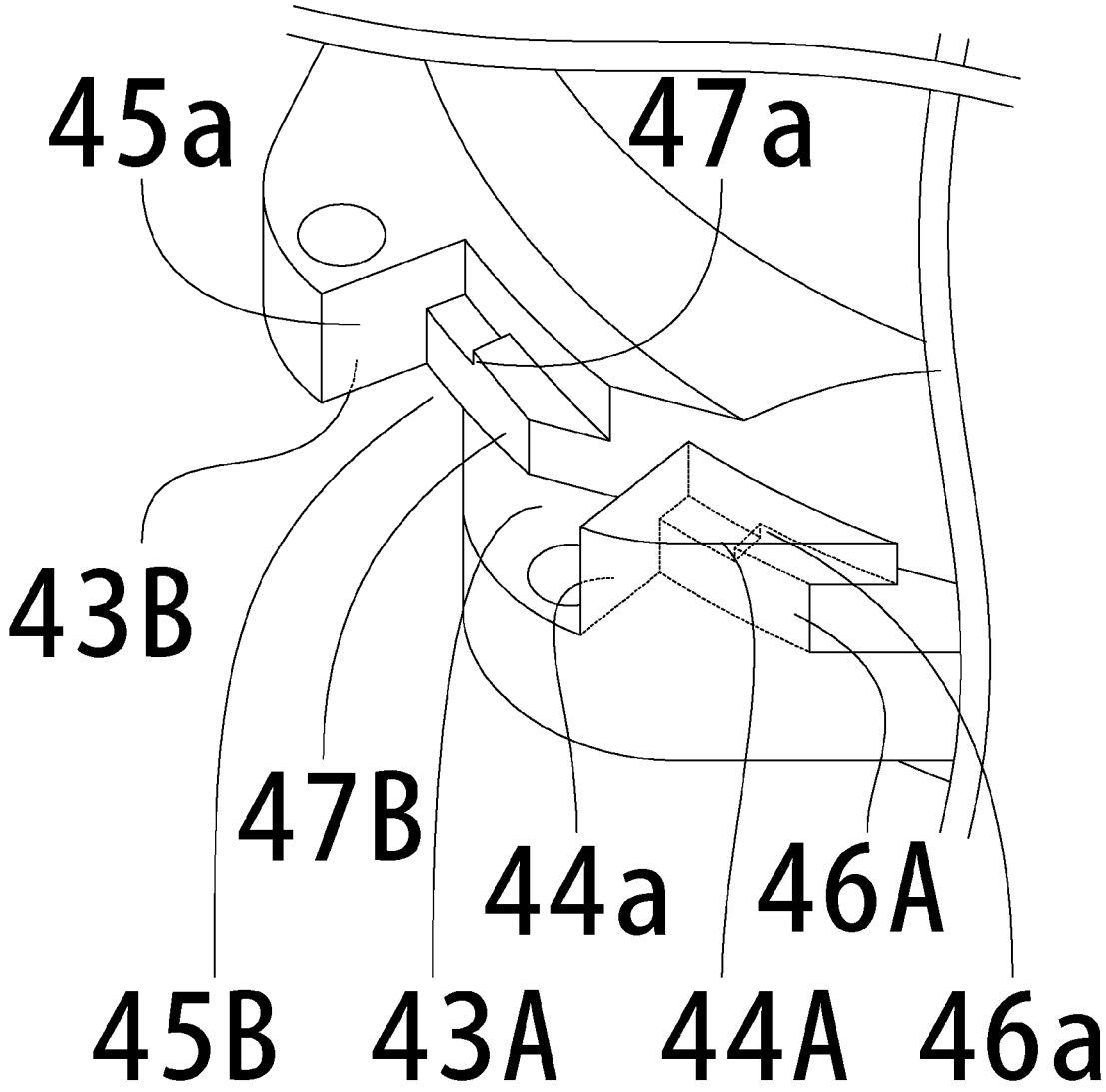
FIGS. 5A and 5B are perspective views of another exemplary coupling structure of the fan unit according to the first preferred embodiment of the present invention.
Figure 5B:
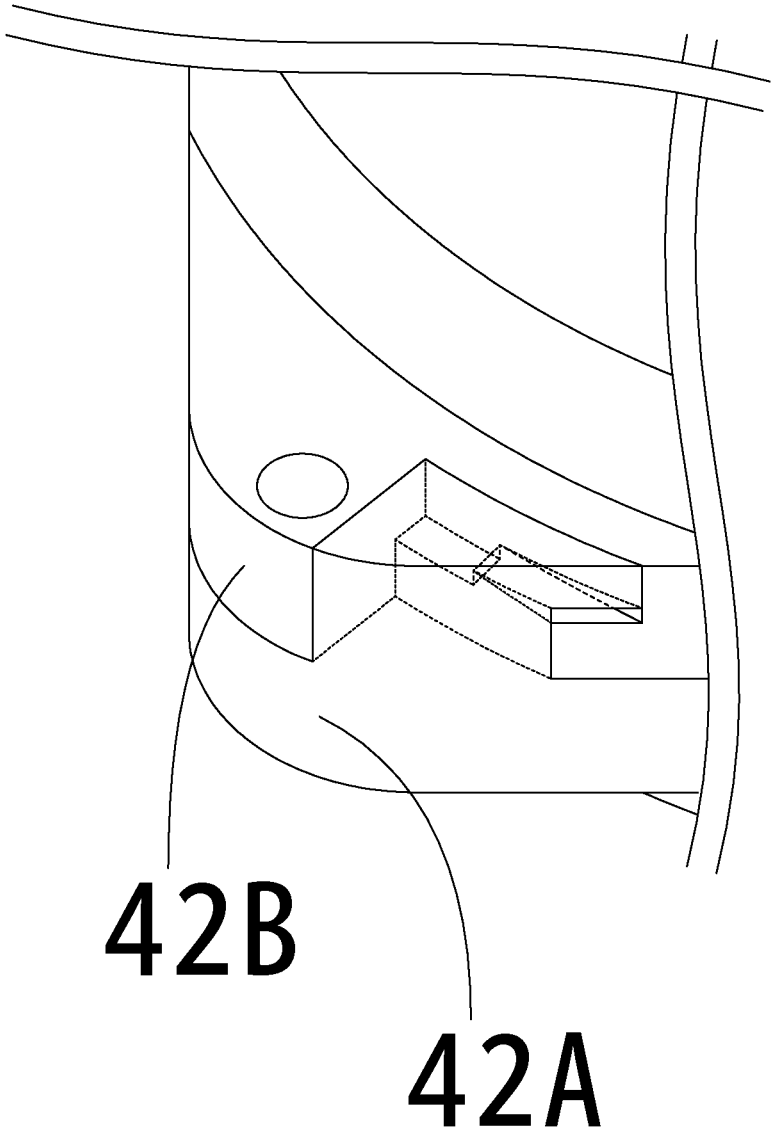

Also, as shown in FIGS. 5A and 5B, an axial protrusion 47*a* defining a tapered step may be provided on each radial protrusion 47B for engagement with an axial recess 46*a* defining a tapered accommodation portion within the radial recess 46A. This structure is conveniently used in the case where the axial fans 10A and 10B, once engaged with each other, are not required to be disassembled.

The axial fans 10A and 10B, if not required to be disassembled after mutual engagement and thus to be coupled more strongly, may also be fixed with adhesive. The use of an adhesive increases the fastening force and can eliminate the vibrations between the housings at the same time.

To fix the axial fans 10A and 10B with even more strength, welding, screwing, pressure bonding, fitting with a separate material may be used instead of the adhesive.

Also, the axial fan 10A and the axial fan 10B may have different characteristics such as air capacity, static pressure, axial thickness, diameter of the impeller 2 or the rotational speed of the impeller 2.

Further, the fan unit 1 may be configured to have three or more axial fans 10 arranged in the axial direction, for example. In the case where a plurality of axial fans 10 make up the fan unit 1, the fixing structure according to the present preferred embodiment further enhances the ease of connecting the axial fans 10.

Further, the protrusion 44A on the flange 42A of one axial fan 10A in the axial direction and the provision of the notch 45B on the flange 42B of the other axial fan 10B makes it possible to couple the axial fans 10A, 10B using a single type of housing 4. Thus, mass production is made possible with reduced production costs.

Also, the axial fans 10A, 10B of the present preferred embodiment are better arranged in such a manner that the impellers 2 of axially adjacent axial fans 10A, 10B are rotated in opposite directions while blowing air in the same axial direction. By doing so, both the static pressure and the air capacity of the fan unit 1 are improved.

As described above, in the fan unit 1 of the present preferred embodiment, the flat housing portions 43A and 43B of the axial fans 10A and 10B are rotated in sliding contact with each other, and therefore the axial fans 10A and 10B can be coupled to each other with a simple operation. In addition, the axial fans 10A and 10B are coupled completely with each other by the engagement between the protrusion 44A and the notch 45B and the friction between the flat housing portions 43A, 43B in contact with each other. Thus, the stress acting on the protrusion 44A and the notch 45B is distributed and an excessive load is prevented from being imposed on the flanges 42A, 42B. As a result, the housing 4 is protected from damage or warping. Also, because the protrusion 44A and the notch 45B engage each other without being displaced outward or forming a gap, as shown in FIG. 2B, there are no air leaks from between the housings 4 to deteriorate the blowing characteristics.

Second Preferred Embodiment

Figure 4A:
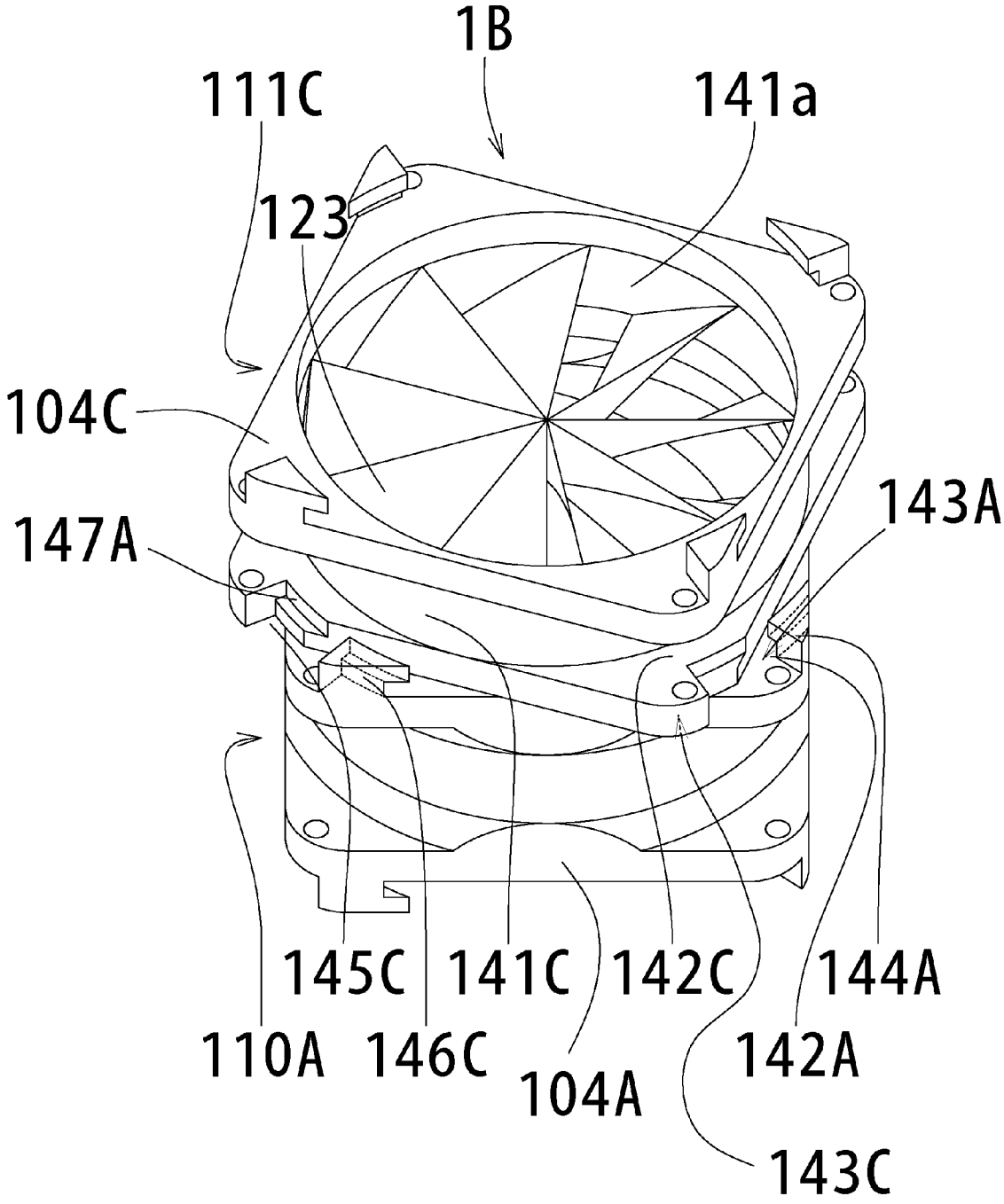
FIGS. 4A and 4B are perspective views of a fan unit according to a second preferred embodiment of the present invention.
Figure 4B:
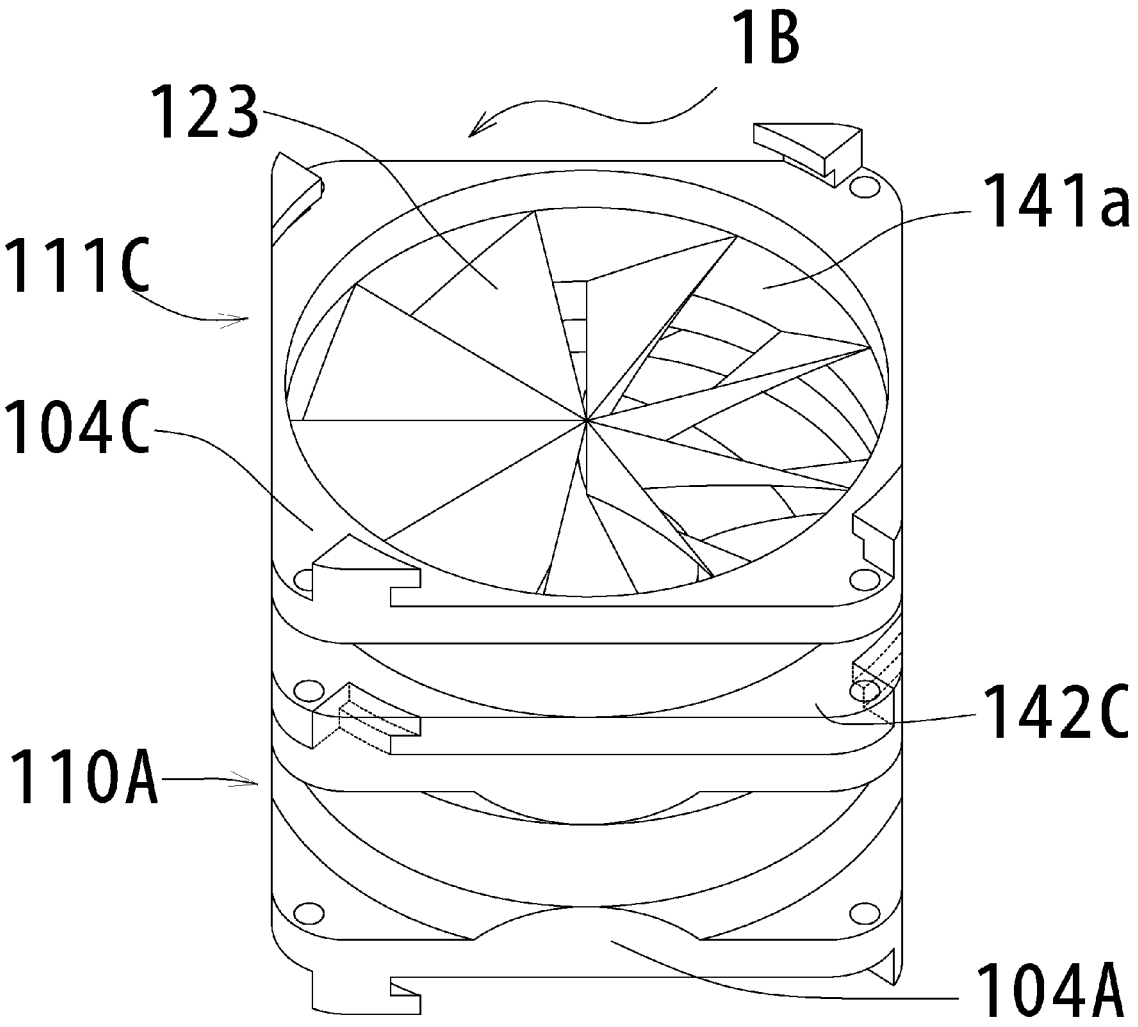

FIGS. 4A and 4B are perspective views of a fan unit according to a second preferred embodiment of the present invention.

Configuration of the Fan Unit

The fan unit 1B of the present preferred embodiment includes an axial fan 110A having a similar structure as the axial fan 10A of the first preferred embodiment and a stationary vane 111C having fixed blades 123 which are combined serially in the direction of the rotational axis. The stationary vane 111C includes the plurality of fixed blades 123 regularly arranged on the circumference and a housing 104C having a cylindrical portion 141C for fixing the outer peripheral ends of the fixed blades 123 on a cylindrical inner side surface 141*a*.

With this configuration, the static pressure characteristics of the axial fan 110A can be improved. In addition, the use of a plurality of the axial fans 110A in combination can further improve the performance of the fan unit 1B.

Housing

The housing 104C of the stationary vane 111C, like the housing 104A of the axial fan 110A, has a plurality of flanges 142C. The flanges 142C each have a similar shape to the flanges 142A of the axial fan 110A. In this way, the stationary vane 111C and the axial fan 110A are arranged serially along the axial direction in such a manner that the flanges 142A and 142C align with each other.

Flanges

The surface of the flanges 142C of the stationary vane 111C which is in contact with the flanges 142A of the axial fan 110A defines a flat housing portion 143C substantially perpendicular to the rotational axis. By doing so, the flat housing portions 143A and 143C are slidably in contact with each other.

The flanges 142C of the stationary vane 111C each have a notch 145C. The protrusion 144A and the notch 145C are so shaped as to complement each other. The protrusion 144A is provided with a radial recess 146C along the periphery around the rotational axis. Also, the notch 145C is provided with a radial protrusion 147A around the rotational axis in the shape corresponding to the radial recess 146C. As an alternative, the protrusion 144A may be provided with the radial protrusion 147A and the notch 145C with the radial recess 146C.

The flat housing portion 143C provided on each flange 142C of the stationary vane 111C and the flat housing portion 143A provided on each flange 142A of the axial fan 110A are brought into contact with each other and rotated around the rotational axis. Then, the radial protrusion 147A is inserted into the radial recess 146C.

As an alternative, the notch 145C may be provided on each flange 142C of the stationary vane 111C and the protrusion 147A on each flange 142A of the axial fan 110A. As another alternative, the notch 145C may be provided on each flange 142C of the stationary vane 111C, and the protrusion 144A may be provided on the corresponding flange 142C along the rotational axis.

In the present preferred embodiment, the fan unit 1B may include at least one axial fan 110A and at least one stationary vane 111C. In this case, the protrusion 144A and the notch 145C may be provided on each component made up of an assembly of several stationary vanes 111C and axial fans 110A. By doing so, the assembly time can be reduced. Also, in the case where the fan unit 1B includes a number of stationary vanes 111C and axial fans 110A, the use of the coupling structure according to the present preferred embodiment and the resulting ease of coupling further enhances the ease of connecting the axial fans.

The axial fans 110A are preferably arranged in such a manner so as to discharge the air in the same direction along the rotational axis of the impeller. The insertion of the stationary vane 111C between two axial fans 110A improves the characteristics of both air capacity and static pressure. Also, the static pressure characteristic is preferably improved by arranging the impellers of the adjacent axial fans, with or without the stationary blade therebetween, to rotate in opposite directions as viewed from the axially upper side.

Third Preferred Embodiment

Figure 6:
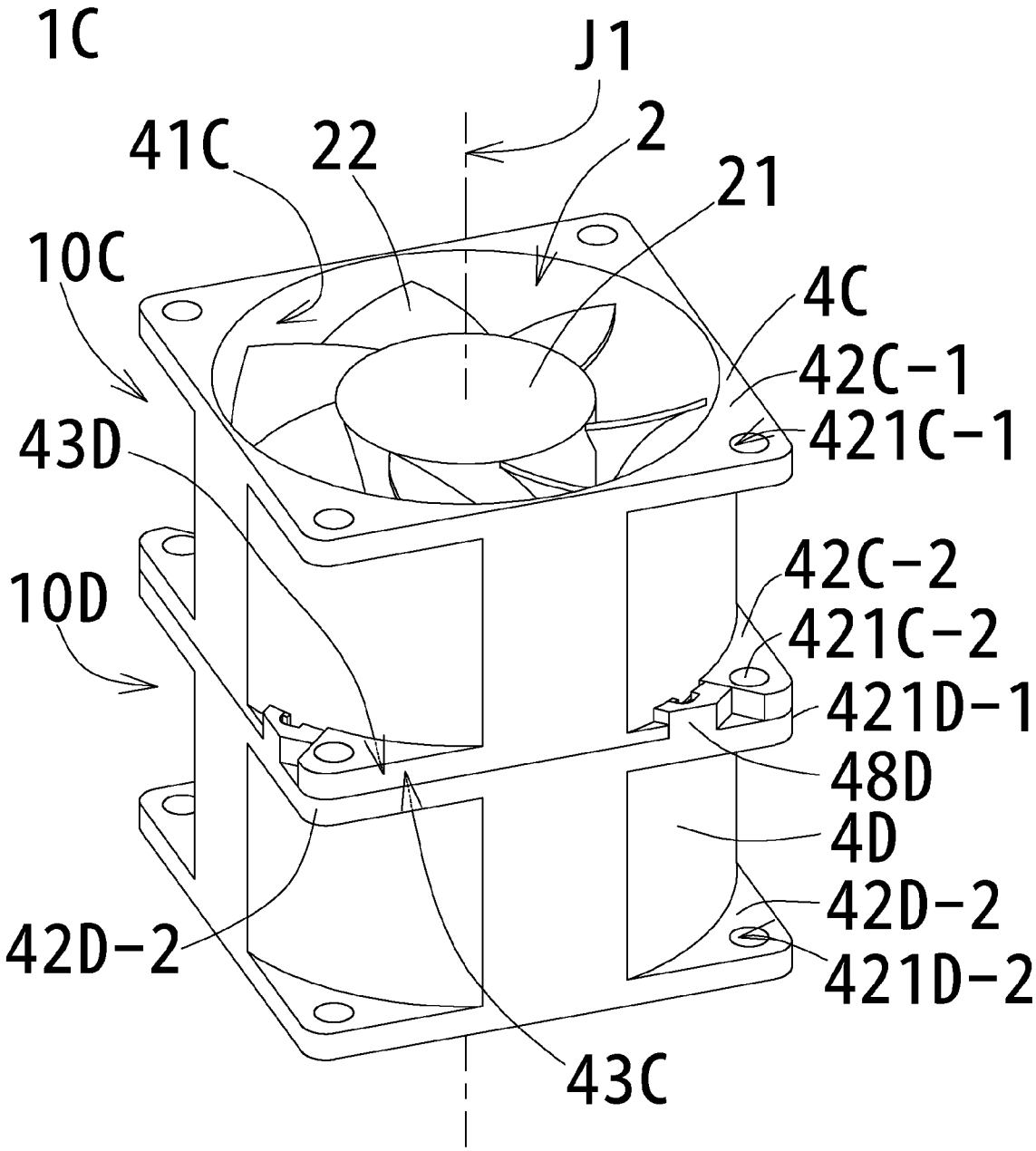
FIG. 6 is a perspective view of a fan unit according to a third preferred embodiment of the present invention.
Figure 7A:
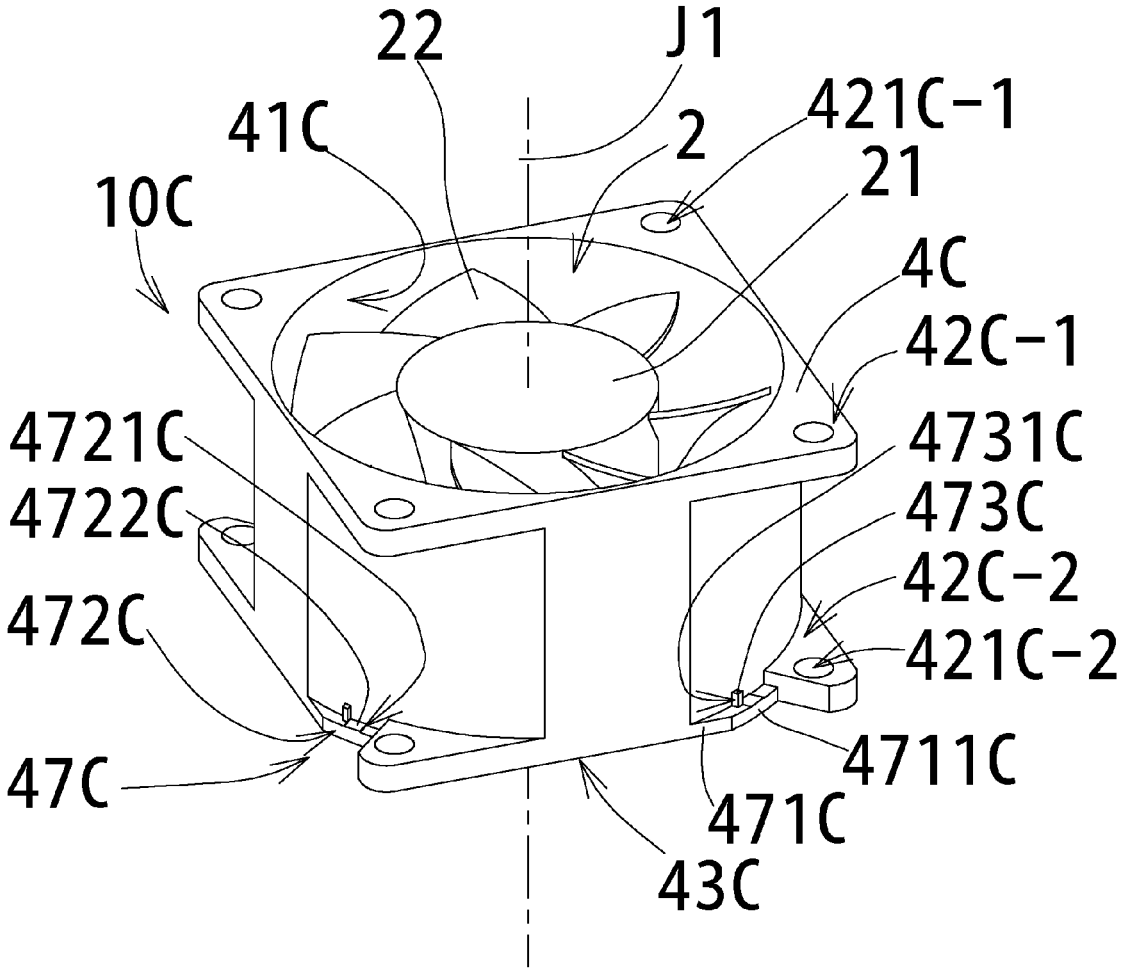
FIG. 7A is a perspective view of an upper axial fan of the fan unit according to the third preferred embodiment of the present invention.
Figure 7B:
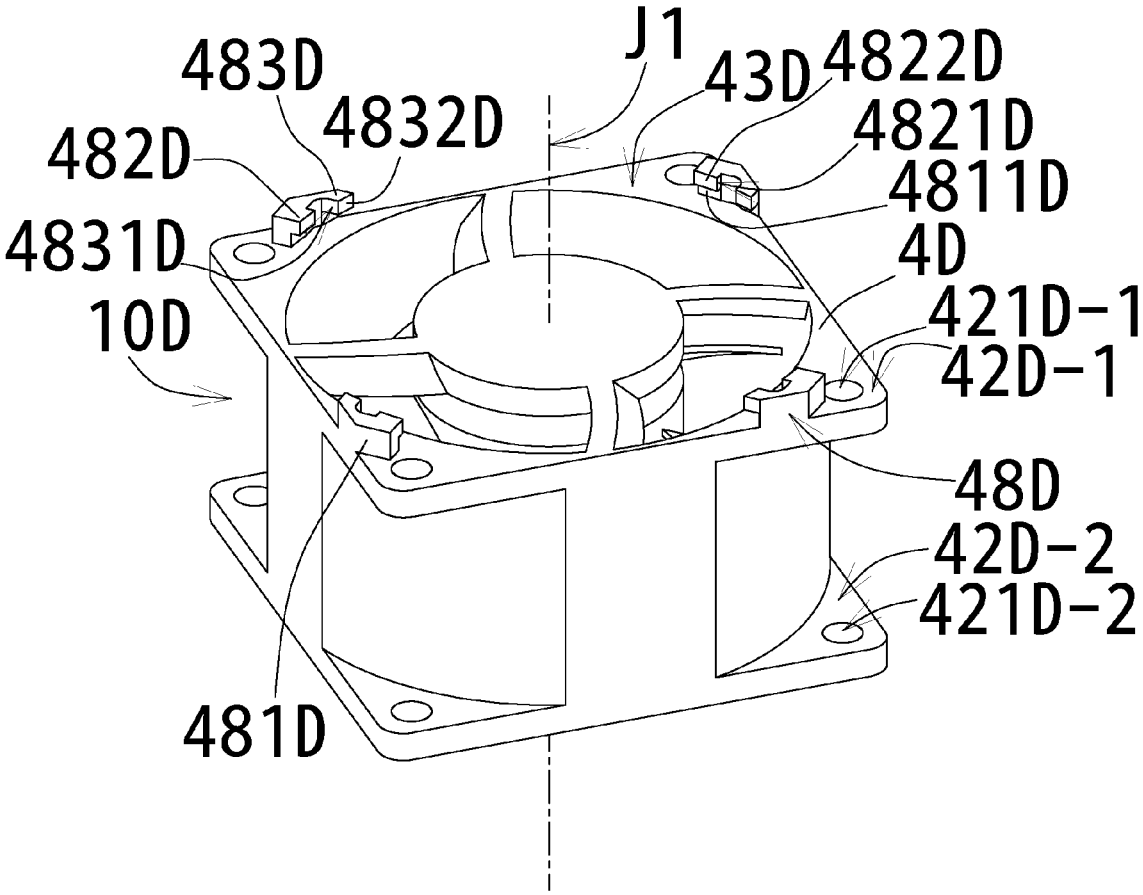
FIG. 7B is a perspective view of a lower axial fan of the fan unit according to the third preferred embodiment of the present invention.
Figure 7C:
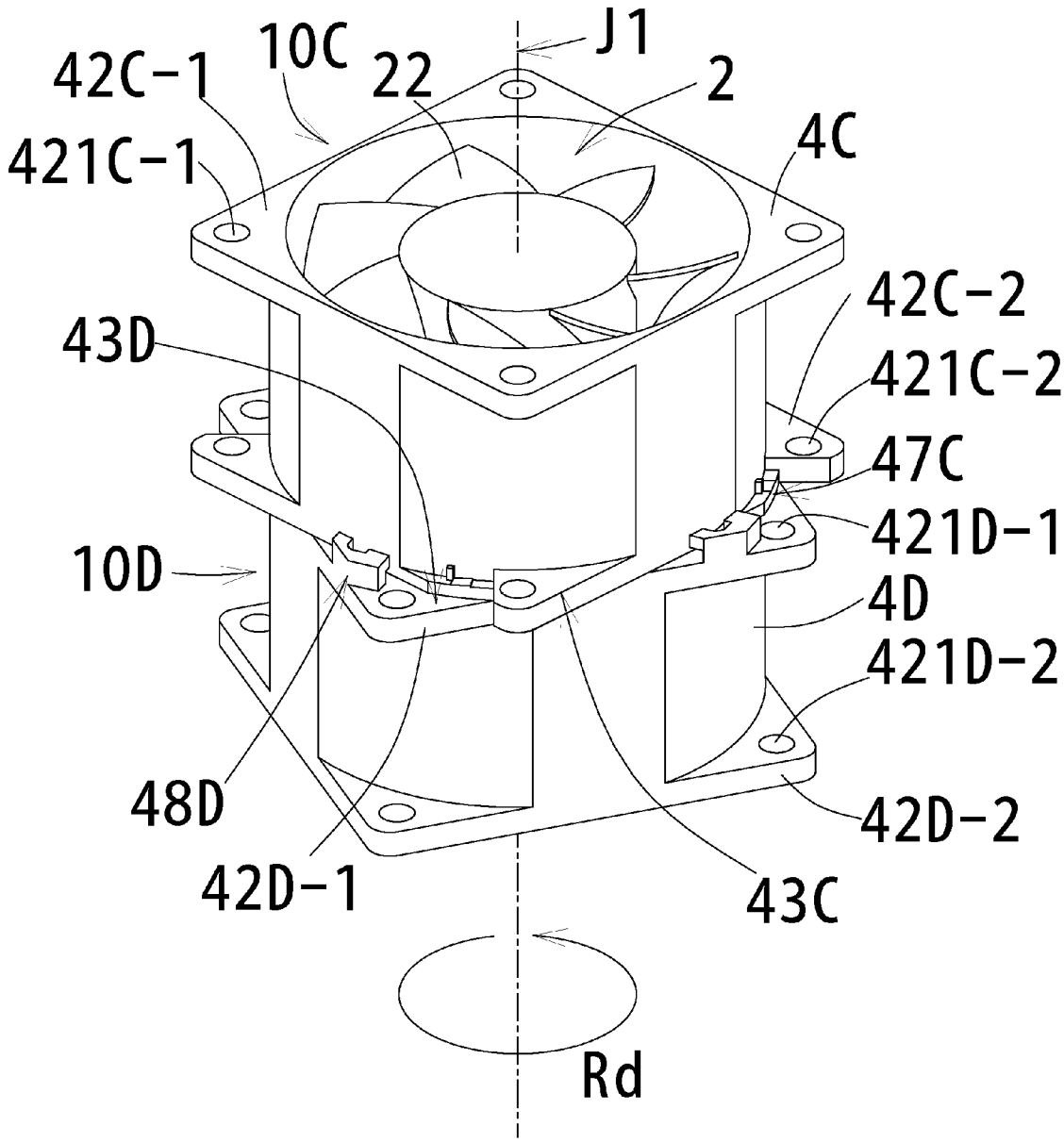
FIG. 7C is a perspective view of the fan unit according to the third preferred embodiment of the present invention, during coupling of the upper and lower axial fans to each other.
Figure 8:
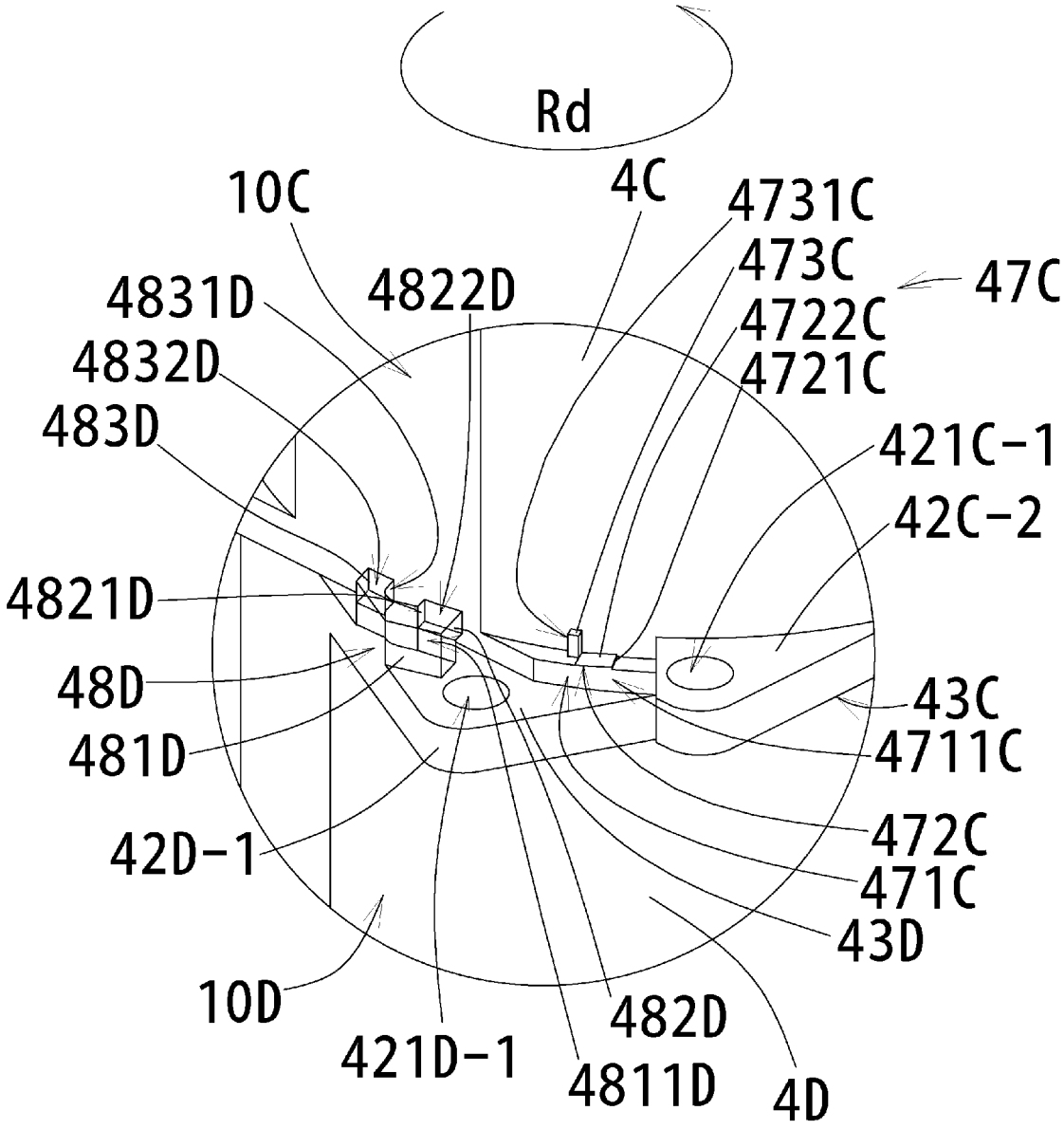
FIG. 8 is an enlarged view of a coupling structure of the fan unit according to the third preferred embodiment of the present invention.

FIG. 6 is a perspective view of a fan unit 1C of the third preferred embodiment, which includes coupling axial fans 10C and 10D to each other. FIGS. 7A, 7B, and 7C are perspective views of the axial fans 10C and 10D before being coupled. FIG. 8 is an enlarged view of an essential portion of the fan unit 1C of the present preferred embodiment, i.e., the structure coupling the axial fans 10C and 10D. In FIGS. 6 through 8, like reference signs designate the same or similar components as in FIGS. 1A to 3C.

Referring to FIG. 6, the fan unit 1C includes axial fans 10C and 10D coaxially arranged with each other. In the present preferred embodiment, the axial fan 10C is arranged above the axial fan 10D, as shown in FIG. 6. The axial fans 10C and 10D are coupled in series in the axial direction.

The axial fans 10C and 10D are basically the same as the axial fans 10A and 10B of the first preferred embodiment but are different at least in the coupling structure. In the following description, the differences between the fan unit 1C of the present preferred embodiment and the fan unit 1A of the first preferred embodiment are mainly described.

The axial fan 10C includes a substantially cylindrical peripheral wall 21 and an impeller 2 having a plurality of blades 22 regularly arranged on the outer side surface of the peripheral wall 21. The axial fan 10C also includes a housing 4C that has an inner radius larger than a distance between an outermost portion of each blade 22 and the center of the housing 4C. The inner side surface 41C of the housing 4C, which is substantially cylindrical in the present preferred embodiment, is substantially concentric with the center axis J1 of the impeller 2 serving as the rotational axis of the impeller 2. That is, the housing 4C defines a substantially cylindrical space therein.

The axial fan 10C can be used independently of the axial fan 10D. However, in the present preferred embodiment, the axial fan 10C is used in combination with another axial fan 10D arranged below the axial fan 10C to define the fan unit 1C. The configuration of the axial fan 10D is the same as the axial fan 10C except for its housing. Therefore, the corresponding components of both axial fans 10C and 10D are labeled with similar reference signs with different suffixes (corresponding to the suffix of the axial fan) and the detailed description thereof is omitted.

The housing 4C has a cylindrical portion arranged about the center axis J1 and is open at both axial ends thereof. A plurality of flanges 42C-1 and 42C-2 are provided at upper and lower ends of the housing 4C, respectively. The flanges 42C-1 and 42C-2 project radially outwards and are preferably arranged about the center axis J1 at four positions at 90° intervals, for example, as shown in FIG. 6. The edges of the flanges 42C-1 and 42C-2 are formed at substantially 90° so that the flanges 42C-1 and 42C-2 as a whole substantially assume the shape of a square or substantially a square when viewed along the center axis J1.

Each flange 42C-1 has an attachment hole 421C-1 penetrating therethrough along the center axis J1. An attachment member such as a screw can be inserted into each attachment hole 421C-1 when the fan unit 1C is attached to another device, e.g., a casing of an electronic device. Similarly, each flange 42C-2 which is provided at the lower end surface of the axial fan 10C to axially oppose the axial fan 10D has an attachment hole 421C-2 for allowing an attachment member to be inserted therethrough. The attachment hole 421C-1 and the attachment hole 421C-2 associated therewith are aligned with each other in the axial direction when the axial fans 10C and 10D are completely coupled to each other, so that a single screw can be inserted into the attachment hole 421C-1 and the associated attachment hole 421C-2.

The axial fan 10D has a housing 4D which is substantially the same as the housing 4C except for the coupling structure that will be described below. Therefore, the detailed description of the housing 4D is omitted here. Please note that attachment holes 421D-1 and 421D-2 of the housing 4D are also aligned with each other and with the attachment holes 421C-1 and 421C-2 of the housing 4C when the axial fans 10C and 10D are completely coupled to each other.

The housings 4C and 4D of the axial fans 10C and 10D together define a housing assembly. The housings 4C and 4D have opposing surfaces 43C and 43D, respectively, which axially oppose each other when the housings 4C and 4D are coupled to each other. More specifically, the surface 43C is the lower end surface of the axial fan 10C, and the surface 43D is the upper end surface of the axial fan 10D, in which surfaces 43C and 43D are substantially perpendicular to the center axis J1.

The coupling of the axial fans 10C and 10D is carried out in the following manner. First, the axial fans 10C and 10D are arranged coaxially with each other so that the lower end surface 43C of the housing 4C is in contact with the upper end surface 43D of the housing 4D, as shown in FIG. 7C. Then, the axial fan 10D is rotated about the center axis J1 relative to the axial fan 10C in a predetermined direction Rd (a counterclockwise direction in the example of FIG. 7C). As a result, the axial fans 10C and 10D are coupled to each other, as shown in FIG. 6. In a state where the axial fans 10C and 10D are completely coupled, four attachment holes 421C-1, 421C-2, 421D-1, and 421D-2 at each corner are aligned with one another in the axial direction.

Next, the coupling of the axial fans 10C and 10D is described in more detail, referring to the coupling structure provided in the housings 4C and 4D.

Referring to FIG. 7A, the housing 4C of the upper axial fan 10C is provided with a lower engaging portion 47C adjacent to the lower end surface 43C. The lower engaging portion 47C is arranged to extend along the outer side surface of the cylindrical portion of the housing 4C so as not to project beyond the outer periphery of the flange 42C-2. In the present preferred embodiment, one end of the lower engaging portion 47C is connected to one flange 42C-2, as shown in FIG. 7A. The lower engaging portion 47C has a protrusion 471C which protrudes from the outer side surface of the cylindrical portion of the housing 4C away from the center axis J1. The lower engaging portion 47C also has a first lower locking portion 472C and a second lower locking portion 473C on the upper end surface of the protrusion 471C. In the present preferred embodiment, the upper end surface of the protrusion 471C is substantially flat and substantially perpendicular to the center axis J1, except for a region where the first and second lower locking portions 472C and 473C are provided. The outer side surface 4711C of the protrusion 471C defines a portion of a cylindrical plane centered about the center axis J1. The axial thickness of the protrusion 471C is preferably thinner than that of the flange 42C-2. The lower end surface of the protrusion 471C is in the same plane as the lower end surface 43C of the housing 4C.

The first lower locking portion 472C provided on the upper end surface of the protrusion 471C includes a contact surface 4721C and a sloping surface 4722C. The sloping surface 4722C which is an upper end surface of the first lower locking portion 472C slopes upward from the upper end surface of the protrusion 471C in the counterclockwise direction in FIG. 7A. An angle of the sloping surface 4722C with respect to the upper end surface of the protrusion 471C can be any angle as long as a sufficient locking performance is achieved. Please note that, in a case of manufacturing the housing by a molding process, a draft angle is also taken into consideration.

The second lower locking portion 473C provided on the upper end surface of the protrusion 471C axially extends upward from the upper end surface of the protrusion 471C along the outer side surface of the cylindrical portion of the housing 4C. The second lower locking portion 473C also has a contact surface 4731C on the opposite side to the first lower locking portion 472C. In the example of FIG. 7A, the contact surface 4731C is an upstream side surface in the counterclockwise direction.

Referring to FIG. 7B, the coupling structure of the housing 4D of the lower axial fan 10D is described. The housing 4D is provided with an upper engaging portion 48D adjacent to the upper end surface 43D of the housing 4D. In the present preferred embodiment, the upper engaging portion 48D projects upward in the axial direction from the upper end surface of the flange 42D-1, as shown in FIG. 7B. The upper engaging portion 48D has a base portion 481D projecting axially upward. The inner side surface 4811D of the base portion 481D, i.e., the radially inner surface thereof, defines a portion of a cylindrical plane centered about the center axis J1. In the present preferred embodiment, the inner side surface 4811D has approximately the same radius as the outer side surface 4711C of the protrusion 471C of the housing 4C (see FIG. 7A).

At the axially upper end of the base portion 481D are provided a first upper locking portion 482D and a second upper locking portion 483D both of which project radially inward from the upper end of the base portion 481D. In the present preferred embodiment, the second upper locking portion 483D is arranged on the upstream side of the first upper locking portion 482D in the counterclockwise direction in FIG. 7B, for example.

The first and second upper locking portions 482D and 483D have contact surfaces 4821D and 4831D, respectively, which oppose each other in the circumferential direction of the cylindrical portion of the housing 4D. Each of the inner side surfaces 4822D and 4832D of the first and second upper locking portions 482D and 483D define a portion of a cylindrical plane centered about the center axis J1. However, the inner side surfaces 4822D and 4832D have a different radius. In the present preferred embodiment, the radius of the inner side surface 4822D is larger than that of the inner side surface 4832D which is approximately the same as the radius of the outer side surface of the cylindrical portion of the housing 4C.

The axial dimension of the space between each of the lower ends of the first and second upper locking portions 482D and 483D and the upper end surface 43D of the housing 4D is approximately the same as or slightly smaller than the axial dimension of the protrusion 471C of the housing 4C of the upper axial fan 10C. In the present preferred embodiment, the axial dimension of the space between each of the first and second upper locking portions 482D and 483D and the upper end surface 43D is smaller than the axial thickness of the protrusion 471C.

The steps for coupling the axial fans 10C and 10D to each other are now described.

First, as shown in FIG. 7C, the axial fans 10C and 10D are arranged coaxially with each other so that the lower end surface 43C of the housing 4C and the upper end surface 43D of the housing 4D are in axial contact with each other. Please note that the upper engaging portion 48D of the housing 4D is arranged on the upstream side of the lower engaging portion 47C of the housing 4C in the counterclockwise direction in FIG. 7C.

Then, the housing 4D is rotated about the center axis J1 relative to the housing 4C in the direction Rd, i.e., the counterclockwise direction in FIG. 7C. As a result, the upper engaging portion 48D engages with the lower engaging portion 47C, and the flanges 42C-1, 42C-2, 42D-1, and 42D-2 at each corner are aligned with one another in the axial direction. In this manner, the fan unit 1C is completely coupled.

FIG. 8 shows the details of the upper and lower engaging portions 48D and 47C.

When the housing 4D is rotated relative to the housing 4C, the upper end surface 43D of the housing 4D slides on the lower end surface 43C of the housing 4C. When the upper engaging portion 48D reaches the lower engaging portion 47C, the protrusion 471C of the lower engaging portion 47C enters into the space between the lower end surface of the first upper locking portion 482D and the upper end surface of the flange 42D-1, i.e., the upper end surface 43D of the housing 4D. In this space, the axial movement of the protrusion 471C is restricted by the first upper locking portion 482D and the flange 42D-1. In addition, the radial movement of the base portion 481D of the housing 4D and the protrusion 471C of the housing 4C is also restricted because the inner side surface 4811D of the base portion 481D and the outer side surface 4711C of the protrusion 471C come into contact with each other in the radial direction. The outer side surface 4711C of the protrusion 471C also guides the upper engaging portion 48D so that the upper engaging portion 48D moves along the direction Rd.

As the housing 4D is rotated further, the first upper locking portion 482D passes outside the second lower locking portion 473C of the housing 4C. Since the inner side surface 4822D of the first upper locking portion 482D has a radius larger than that of the outer side surface of the second lower locking portion 473C in the present preferred embodiment, the first upper locking portion 482D does not come into contact with the second lower locking portion 473C.

When the housing 4D is rotated further, the lower end surface of the first upper locking portion 482D reaches the sloping surface 4722C of the second upper locking portion 472C. Therefore, with the rotation of the housing 4D, the first upper locking portion 482D is elastically deformed upward in the axial direction by the sloping surface 4722C.

When the housing 4D is further rotated, the protrusion 471C enters into the space between the lower end surface of the second upper locking portion 483D and the flange 42D-1 (i.e., the upper end surface 43D of the housing 4D). In this space, the axial movement of the protrusion 471C is restricted by the second upper locking portion 483D and the flange 42D-1. Then, as the housing 4D is rotated further, the contact surface 4831D of the second upper locking portion 483D comes into contact with the contact surface 4731C of the second lower locking portion 473C in the direction Rd. At this time, the first upper locking portion 482D is located on the upper surface of the sloping surface 4722C of the first lower locking portion 472C.

When the housing 4D is further rotated while the contact surface 4831D of the second upper locking portion 483D is in contact with the contact surface 4731C of the second lower locking portion 473C, the first upper locking portion 482D moves forward of the sloping surface 4722C of the second lower locking portion 472C in the direction Rd with the second upper locking portion 483D elastically deformed. As a result, the upward deformation of the first upper locking portion 482D is released, and the lower end surface of the first upper locking portion 482D comes into contact with the upper end surface of the protrusion 471C.

Subsequently, the second upper locking portion 483D which is elastically deformed pulls the first upper locking portion 482D toward the opposite direction to the direction Rd. At this time, the contact surface 4821D of the first upper locking portion 482D comes into contact with the contact surface 4721C of the first lower locking portion 472C. In the present preferred embodiment, the distance between the contact surface 4821D of the first upper locking portion 482D and the contact surface 4831D of the second lower locking portion 483D in the direction Rd is smaller than the distance between the contact surface 4721C of the first lower locking portion 472C and the contact surface 4731C of the second upper locking portion 473C in the direction Rd. Therefore, the first and second upper locking portions 482D and 483D are pressed toward the direction Rd and the direction opposite thereto by the first and second lower locking portions 472C and 473C. Therefore, further rotation of the housing 4D relative to the housing 4C about the center axis J1 is prevented. Also, the coupling of the housings 4C and 4D has no play.

In addition, the protrusion 471C is axially sandwiched between a portion of the upper engaging portion 48D and the upper end surface of the housing 4D while being pressed from both axial sides (i.e., in two axial directions) to cause elastic axial deformation of the protrusion 471C. Therefore, the axial movement of the housings 4C and 4D is also prevented.

The aforementioned coupling structure is also preferably provided at the other three corners of the housings 4C and 4D, for example. Accordingly, it is possible to reduce possibilities that the engaging portions may be broken by a force applied substantially perpendicularly to the center axis J1.

In the present preferred embodiment, the engaging portion is preferably integral with the corresponding housing and preferably formed by injection molding using a single resin or plastic. This can minimize the increase in the manufacturing cost because the housing can be mass-produced by using a molding die.

Fourth Preferred Embodiment

Figure 9:
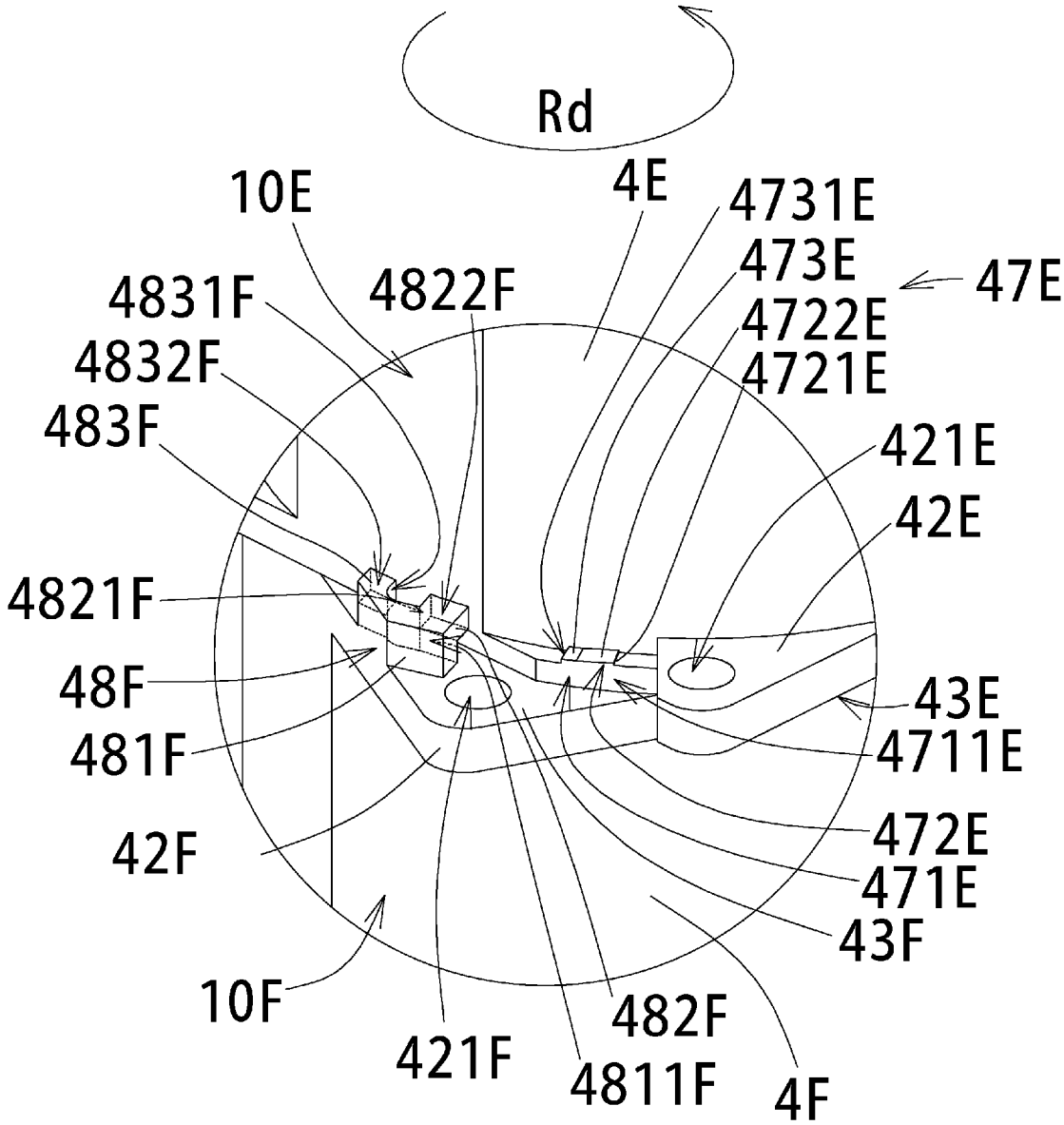
FIG. 9 is an enlarged view of a coupling structure of a fan unit according to a fourth preferred embodiment of the present invention.

FIG. 9 is an enlarged view of the coupling structure of a fan unit according to a fourth preferred embodiment of the present invention.

Except for the coupling structure, the fan unit of the present preferred embodiment preferably is substantially the same as that of the third preferred embodiment. Therefore, the coupling structure is mainly described in the following description. Please note the corresponding components of the fan units of the present preferred embodiment and the third preferred embodiment are labeled with reference signs with different suffixes. The suffixes correspond to the suffixes of the axial fans.

Referring to FIG. 9, a housing 4E of an upper axial fan 10E is provided with a lower engaging portion 47E adjacent to the upper end surface thereof. The lower engaging portion 47E extends in the circumferential direction of the outer side surface of the cylindrical portion of the housing 4E, as shown in FIG. 9. The lower engaging portion 47E has a protrusion 471E which protrudes from the outer side surface of the cylindrical portion of the housing 4E away from the center axis J1. The lower engaging portion 47E also has a first lower locking portion 472E and a second lower locking portion 473E on the upper end surface of the protrusion 471E. The upper end surface of the protrusion 471E is substantially flat and substantially perpendicular to the center axis J1, except for a region where the first and second lower locking portions 472E and 473E are provided. The outer side surface 4711E of the lower engaging portion 471E defines a portion of a cylindrical plane centered about the center axis J1. The axial thickness of the protrusion 471E is preferably less than that of the flange 42E. The lower surface of the protrusion 471E is in the same plane as the lower end surface 43E of the housing 4E. As shown in FIG. 9, the protrusion 471E extends in the circumferential direction of the cylindrical portion of the housing 4E so as not to project beyond the outer edge of the flange 42E, and is connected to the flange 42E at one end thereof, i.e., the end closer to the first lower locking portion 472E than to the second lower locking portion 473E. Please note that the flange 42E has substantially the same configuration as the flanges of the axial fans of the third preferred embodiment. Also, attachment holes 421E, 421F are provided in the flanges 42E, 42F, respectively.

The first lower locking portion 472E on the upper end surface of the protrusion 471E includes a contact surface 4721E and a sloping surface 4722E, as shown in FIG. 9. The sloping surface 4722E slopes upward in the clockwise direction to the contact surface 4721E in FIG. 9. An angle of the contact surface 4721E with respect to the upper end surface of the can be any angle, as long as a sufficient locking performance can be achieved. Please note that, in a case of manufacturing the housing by a molding process, a draft angle is also taken into consideration.

The second lower locking portion 473E provided on the upper end surface of the protrusion 471E is arranged to the left of the first lower locking portion 472E in the example of FIG. 9, so as to be continuous with the first lower locking portion 472E. More specifically, the upper surface of the second lower locking portion 473E is continuous with the sloping surface 4722E of the first lower locking portion 472E. That is, the height of the upper end surface of the second lower locking portion 473E from the upper surface of the protrusion 471E is substantially the same as the minimum height of the sloping surface 4722E of the first lower locking portion 472E from the upper surface of the protrusion 471E. Please note that the minimum height of the sloping surface 4722E is the height thereof at the end of the sloping surface 4722E connected to the second lower locking portion 473E in the present preferred embodiment. The second lower locking portion 473E has a contact surface 4731E at the opposite end to the first lower locking portion 472E. Similarly with the angle of the contact surface 4721E, an angle of the contact surface 4731E with respect to the upper end surface of the protrusion 471E can be any angle as long as a sufficient locking performance can be achieved. Also, a draft angle is taken into consideration when the housing 4E is manufactured by a molding process.

A housing 4F of the lower axial fan 10F is provided with an upper engaging portion 48F adjacent to the upper end surface thereof. The upper engaging portion 48F projects upward in the axial direction from the upper end surface of the flange 42F, as shown in FIG. 9. The upper engaging portion 48F has a base portion 481F projecting axially upward. The inner side surface 4811F of the base portion 481F, i.e., the radially inner surface thereof defines a portion of a cylindrical plane centered about the center axis J1. In the present preferred embodiment, the inner side surface 4811F preferably has approximately the same radius as the outer side surface 4711E of the protrusion 471E of the housing 4E.

At the axially upper end of the base portion 481F are provided a first upper locking portion 482F and a second upper locking portion 483F, both of which project radially inward from the upper end of the base portion 481F. In the present preferred embodiment, the first upper locking portion 482F is arranged on the downstream side of the second upper locking portion 483F in the counterclockwise direction in FIG. 9, which corresponds to the direction of rotation of the housing 4F described later, for example.

The first upper locking portion 482F and the second upper locking portion 483F have contact surfaces 4821F and 4831F, respectively, which oppose each other. Each of the inner side surfaces 4822F and 4832F of the first and second upper locking portions 482F and 483F define a portion of a cylindrical plane centered about the center axis J1. The inner side surfaces 4822F and 4832F have substantially the same radius as each other. Also, the inner side surfaces 4822F and 4832F have approximately the same radius as the outer side surface of the housing 4E of the upper axial fan 10E.

The axial dimension of the space between the lower end surface of the first upper locking portion 482F and the upper end surface 43F of the housing 4F, i.e., the height of the lower end surface of the first upper locking portion 482F from the upper end surface 43F is approximately the same as or slightly smaller than the total axial thickness of the protrusion 471E of the housing 4E and the axial thickness of the second lower locking portion 473E. Moreover, the axial dimension of the space between the lower end surface of the second upper locking portion 483F and the upper end surface 43F is approximately the same as or slightly smaller than the axial thickness of the protrusion 471E of the housing 4E.

The coupling of the axial fans 10E and 10F to each other is now described.

First, the axial fans 10E and 10F are arranged coaxially with each other so that the lower end surface 43E of the housing 4E and the upper end surface 43F of the housing 4F are in axial contact with each other, as shown in FIG. 9. In this step, the housing 4F is shifted relative to the housing 4E with the upper engaging portion 48F arranged on the upstream side of the lower engaging portion 47E in the counterclockwise direction in FIG. 9.

Then, the housing 4F is rotated about the center axis J1 relative to the housing 4E in the direction Rd. In the present preferred embodiment, the direction Rd is the counterclockwise direction. As a result, the lower engaging portion 47E engages with the upper engaging portion 48F, thereby completing the fan unit.

In this relative rotation, the lower end surface 43E of the housing 4E slides on the upper end surface 43F of the housing 4F. When the upper engaging portion 48F reaches the lower engaging portion 47E, the protrusion 471E of the lower engaging portion 47E enters the space between the lower end surface of the first upper locking portion 482F and the upper end surface of the flange 42F, i.e., the upper end surface 43F of the housing 4F. At the same time, the inner side surface 4811F of the base portion 481F of the upper engaging portion 48F and the outer side surface 4711E of the protrusion 471E of the lower engaging portion 471E come into contact with each other in the radial direction. Thus, the radial movement of the base portion 481F and the protrusion 471E is also restricted. The outer side surface 4711E of the protrusion 471E guides the upper engaging portion 48F in the direction Rd.

When the housing 4F is rotated further, the first upper locking portion 482F passes over the second lower locking portion 473E.

Then, the lower end surface of the first upper locking portion 482F reaches the upper surface of the sloping surface 4722E of the second upper locking portion 473E. Therefore, with the rotation of the housing 4F, the first upper locking portion 482F is elastically deformed upward in the axial direction by the sloping surface 4722E.

As the housing 4F is rotated further, the protrusion 471E enters into the space between the lower end surface of the second upper locking portion 483F and the flange 42F, i.e., the upper end surface 43F of the housing 4F. In this space, the axial movement of the protrusion 471E is restricted by the second upper locking portion 483F and the flange 42F. Then, as the housing 4F is rotated further, the contact surface 4831F of the second upper locking portion 483F comes into contact with the contact surface 4731E of the second lower locking portion 473E. At this time, the first upper locking portion 482F is located on the upper surface (sloping surface) 4722E of the first lower locking portion 472E.

When the housing 4F is rotated further while the contact surface 4831F of the second upper locking portion 483F is in contact with the contact surface 4731E of the second lower locking portion 473E, the first upper locking portion 482F is forced to move forward of the sloping surface 4722E of the second upper locking portion 472E in the direction Rd with the second upper locking portion 483F elastically deformed. As a result, the upward deformation of the first upper locking portion 482F is released, and the lower end surface of the first upper locking portion 482F comes into contact with the upper end surface of the protrusion 471E.

Subsequently, the second upper locking portion 483F which is elastically deformed pulls the first upper locking portion 482F toward the opposite direction to the direction Rd. At this time, the contact surface 4821F of the first upper locking portion 482F comes into contact with the contact surface 4721E of the first lower locking portion 472E in the direction Rd. The distance between the contact surface 4821F of the first upper locking portion 482F and the contact surface 4831F of the second upper locking portion 483F in the direction Rd is smaller than the distance between the contact surface 4721E of the first lower locking portion 472E and the contact surface 4731E of the second lower locking portion 473E in the direction Rd in the present preferred embodiment. Therefore, the first and second upper locking portions 482F and 483F are pressed toward the direction Rd and the direction opposite thereto by the first and second upper locking portions 472E and 473E. Therefore, further rotation of the housing 4F relative to the housing 4E about the center axis J1 is prevented. Also, the coupling of the housings 4E and 4F has no play.

In addition, the protrusion 471E is axially sandwiched between a portion of the upper engaging portion 48F and the upper end surface of the housing 4F while being pressed from both axial sides (i.e., in two axial directions) to cause elastic axial deformation of the protrusion 471E. Therefore, the axial movement of the housings 4C and 4D is also prevented.

Fifth Preferred Embodiment

Figure 10:
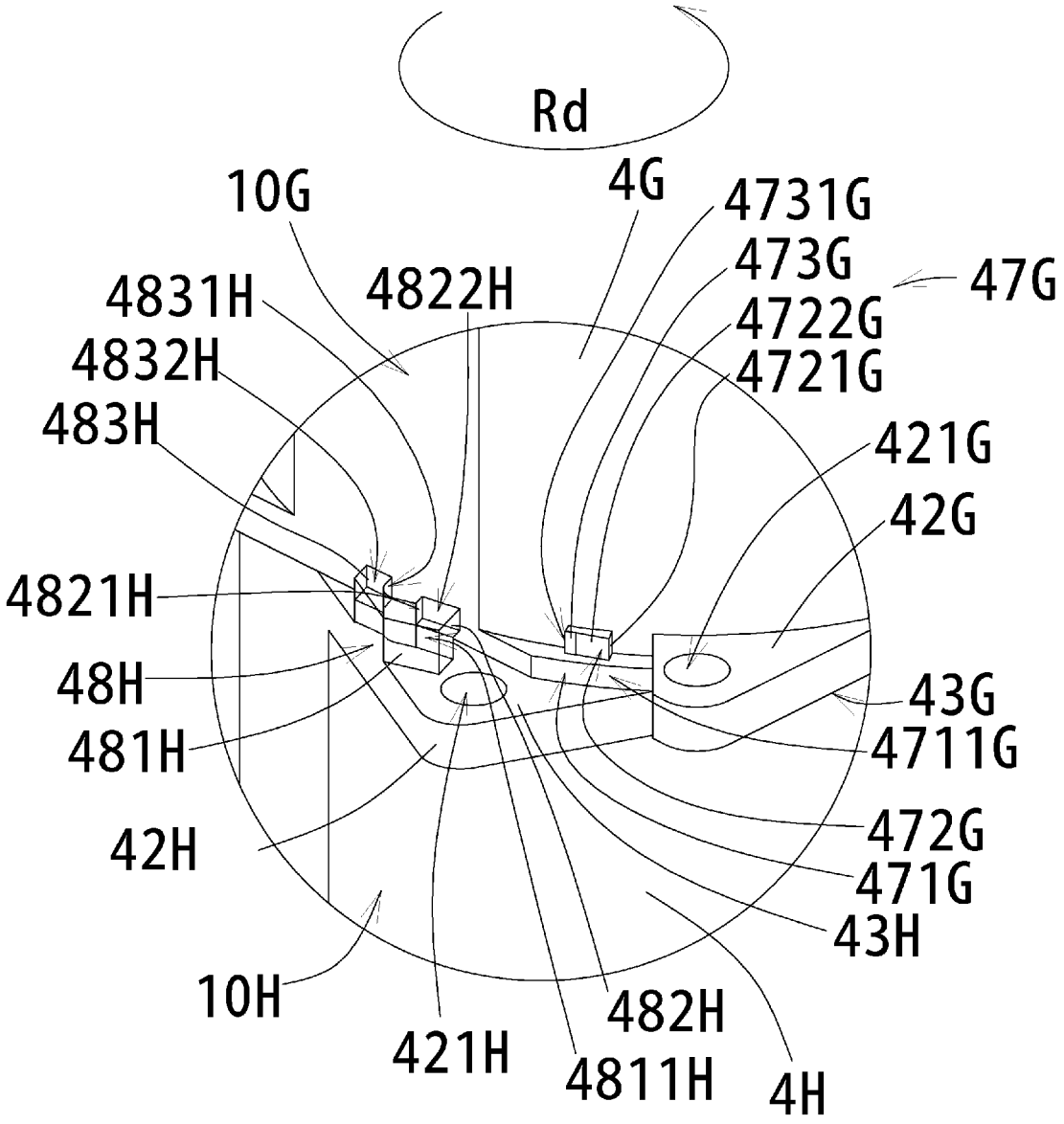
FIG. 10 is an enlarged view of a coupling structure of a fan unit according to a fifth preferred embodiment of the present invention.

FIG. 10 is an enlarged view of the coupling structure of a fan unit according to a fifth preferred embodiment of the present invention.

Except for the coupling structure, the fan unit of the present preferred embodiment is substantially the same as that of the third preferred embodiment. Therefore, the coupling structure is mainly described in the following description. Please note the corresponding components of the fan units of the present preferred embodiment and the third preferred embodiment are labeled with reference signs with different suffixes. The suffixes correspond to the suffixes of the axial fans.

Referring to FIG. 10, a housing 4G of an upper axial fan 10G is provided with a lower engaging portion 47G adjacent to the lower end surface thereof. The lower engaging portion 47G extends in the circumferential direction of the cylindrical portion of the housing 4G, as shown in FIG. 10. The lower engaging portion 47G has a protrusion 471G which protrudes from the outer side surface of the cylindrical portion of the housing 4G away from the center axis J1. The lower engaging portion 47G also has a first lower locking portion 472G and a second lower locking portion 473G on the upper end surface of the protrusion 471G. The upper end surface of the protrusion 471G is substantially flat and substantially perpendicular to the center axis J1 except for a region where the first and second lower locking portions 472G and 473G are provided in the present preferred embodiment. The outer side surface 4711G forms a portion of a cylindrical plane centered about the center axis J1. The axial thickness of the protrusion 471G is preferably thinner than that of the flange 42G. The lower end surface of the protrusion 471G is in the same plane as the lower end surface of the housing 4G. The protrusion 471G extends in the circumferential direction of the cylindrical portion of the housing 4G so as not to project beyond the outer edge of the flange 42G, and is connected to the flange 42G at one end which is closer to the first lower locking portion 4721G than to the second lower locking portion 4731G. Also, attachment holes 421G, 421H are provided in the flanges 42G, 42H, respectively The first lower locking portion 472G provided on the upper end surface of the protrusion 471G projects from the protrusion 471G upward in the axial direction along the outer side surface of the cylindrical portion of the housing 4G. The first lower locking portion 472G is configured by a contact surface 4721G and a sloping surface 4722G as an outer side surface. The sloping surface 4722G slopes such that it extends away from the outer side surface of the cylindrical portion of the housing 4G as it extends in the clockwise direction in FIG. 10. The contact surface 4721G is arranged at the upstream end of the sloping surface 4722G in the clockwise direction. An angle of the contact surface 4721G can be any angle as long as a sufficient locking performance can be achieved. In a case of manufacturing the housing 4G by molding, a draft angle is also taken into consideration when the angle of the contact surface 4721G is set.

The second lower locking portion 473G provided on the upper end surface of the protrusion 471G projects from the protrusion 471G upward in the axial direction along the outer side surface of the cylindrical portion of the housing 4G. The second lower locking portion 473G is arranged on the upstream side of the first lower locking portion 472G in the counterclockwise direction which is the direction of rotation of the housing 4H described later. The outer side surface of the second lower locking portion 473G is continuous with the sloping surface 4722G of the first lower locking portion 472G. In other words, the distance of the outer side surface of the second lower locking portion 473G from the center axis J1 is substantially the same as the minimum distance of the sloping surface 4722G of the first lower locking portion 472G from the center axis J1. The second lower locking portion 473G has a contact surface 4731G at the opposite end to the first lower locking portion 472G.

A housing 4H of a lower axial fan 10H is provided with an upper engaging portion 48H adjacent to the upper end surface thereof. The upper engaging portion 48H protrudes upward in the axial direction from the upper surface of the flange 42H, as shown in FIG. 10. The upper engaging portion 48H has a base portion 481H projecting axially upward. The inner side surface 4811H of the base portion 481H, i.e., the radially inner surface thereof forms a portion of a cylindrical plane centered about the center axis J1. In the present preferred embodiment, the inner side surface 4811H preferably has approximately the same radius as the outer side surface 4711G of the protrusion 471G of the housing 4G.

At the axially upper end of the base portion 481H are provided a first upper locking portion 482H and a second upper locking portion 483H both of which project radially inward from the upper end of the base portion 481H. In the present preferred embodiment, the first upper locking portion 482H is arranged on the downstream side of the second upper locking portion 483H in the counterclockwise direction in FIG. 10, for example.

The first and second upper locking portions 482H and 483H have contact surfaces 4821H and 4831H, respectively, which oppose each other. Each of the inner side surfaces 4822H and 4832H of the first and second upper locking portions 482H and 483H forms a portion of a cylindrical plane centered about the center axis J1. However, the inner side surfaces 4822H and 4832H are different from each other in their radius. In the present preferred embodiment, the radius of the inner side surface 4822H is larger than that of the inner side surface 4832H that is approximately the same as the radius of the outer side surface of the cylindrical portion of the housing 4G.

The axial dimension of the space between each of the first and second upper locking portions 482H and 483H and the upper end surface 43H of the housing 4H is approximately the same as or slightly smaller than the axial thickness of the protrusion 471G of the housing 4G.

The coupling of the axial fans 10G and 10H to each other is now described.

First, the axial fans 10G and 10H are arranged coaxially with each other so that the lower end surface of the housing 4G and the upper end surface 422H of the housing 4H are in axial contact with each other, as shown in FIG. 10. In this step, the housing 4H is shifted relative to the housing 4G with the upper engaging portion 48H arranged on the upstream side of the lower engaging portion 47G in the counterclockwise direction in FIG. 10 in which the housing 4H is to be rotated.

Then, the housing 4H is rotated about the center axis J1 relative to the housing 4G in the direction Rd. In the present preferred embodiment, the direction Rd is the counterclockwise direction in FIG. 10. As a result, the lower engaging portion 47G engages with the upper engaging portion 48H, thereby completing the fan unit of the present preferred embodiment.

During the relative rotation, the lower end surface of the housing 4G slides on the upper end surface of the housing 4H. When the upper engaging portion 48H reaches the lower engaging portion 47G, the protrusion 471G of the housing 4G enters the space between the lower end surface of the first upper locking portion 482H and the flange 42H (i.e., the upper end surface 43H of the housing 4H). At the same time, the inner side surface 4811H of the base portion 481H of the housing 4H and the outer side surface 4711G of the protrusion 471G of the housing 4G come into contact with each other in the radial direction. Thus, the radial movement of the base portion 481H and the protrusion 471G is restricted. The outer side surface 4711G of the protrusion 471G guides the upper engaging portion 48H so that the upper engaging portion 48H moves along the direction Rd.

When the housing 4H is rotated further, the first upper locking portion 482H passes outside the second lower locking portion 473G in the radial direction.

Then, the lower end surface of the first upper locking portion 482H reaches the sloping surface 4722G of the second upper locking portion 472G, as the housing 4H is rotated further. While passing by the sloping surface 4722G, the first upper locking portion 482H is elastically deformed radially outwards, i.e., in a direction away from the center axis J1, by the sloping surface 4722G.

When the housing 4H is rotated further, the protrusion 471G enters into the space between the lower end surface of the second upper locking portion 483H and the flange 42H (i.e., the upper end surface 422H of the housing 4H). In this space, the axial movement of the protrusion 471G is restricted by the second upper locking portion 483H and the flange 42H so as not to make axial movement. As the housing 4H is rotated further, the contact surface 4831H of the second upper locking portion 483H comes into contact with the contact surface 4731G of the second lower locking portion 473G in the direction Rd. At this time, the first upper locking portion 482H is located radially outside the sloping surface 4722G of the first lower locking portion 472G.

When the housing 4H is further rotated while the contact surface 4831H of the second upper locking portion 483H is in contact with the contact surface 4731G of the second lower locking portion 473G, the first upper locking portion 482H is forced to move forward of the outer side surface 4722G of the second upper locking portion 472G in the direction Rd with the second upper locking portion 483H elastically deformed. As a result, the radially outward deformation of the first upper locking portion 482H is released and the inner side surface 4822H of the first upper locking portion 482H comes into contact with the outer side surface of the cylindrical portion of the housing 4G.

Subsequently, the second upper locking portion 483H which is elastically deformed pulls the first upper locking portion 482H toward the opposite direction to the direction Rd. At this time, the contact surface 4821H of the first upper locking portion 482H comes into contact with the contact surface 4721G of the first lower locking portion 472G in the direction Rd. In the present preferred embodiment, the distance between the contact surface 4821H of the first upper locking portion 482H and the contact surface 4831H of the second upper locking portion 483H in the direction Rd is smaller than the distance between the contact surface 4721G of the first lower locking portion 472G and the contact surface 4731G of the second lower locking portion 473G in the rotating direction Rd. Therefore, the first and second upper locking portions 482H and 483H are pressed toward the direction Rd and the direction opposite thereto by the first and second lower locking portions 472G and 473G. Therefore, further rotation of the housing 4H relative to the housing 4G about the center axis J1 is prevented. Also, the coupling of the housings 4G and 4H has no play.

In addition, the protrusion 471G is axially sandwiched between a portion of the upper engaging portion 48H and the upper end surface of the housing 4H while being pressed from both axial sides (i.e., in two axial directions) to cause elastic axial deformation of the protrusion 471G. Therefore, the axial movement of the housings 4G and 4H is also prevented.

Sixth Preferred Embodiment

Figure 11:
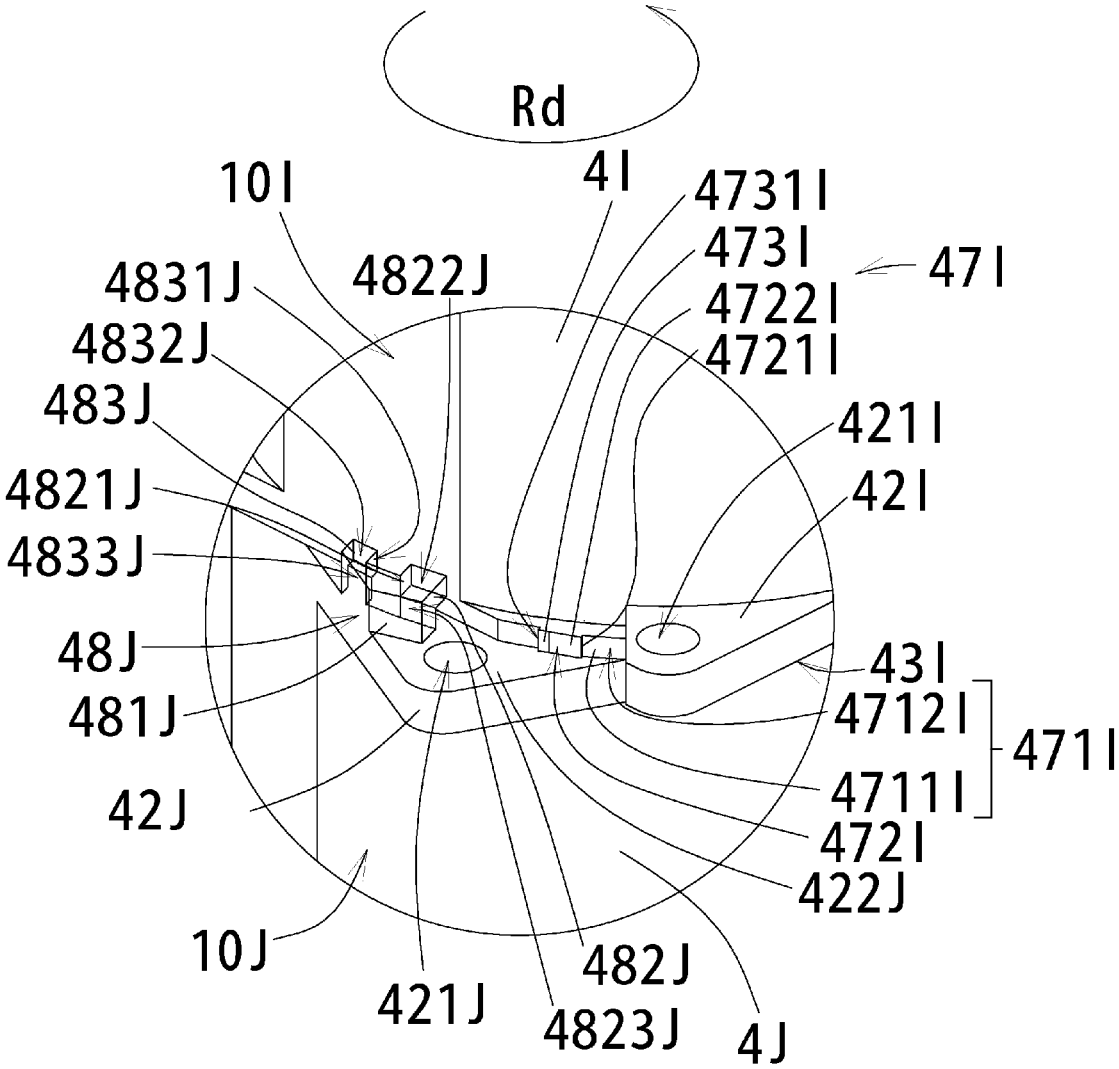
FIG. 11 is an enlarged view of a coupling structure of a fan unit according to a sixth preferred embodiment of the present invention.

FIG. 11 is an enlarged view of the coupling structure of a fan unit according to a sixth preferred embodiment of the present invention.

The fan unit of the present preferred embodiment is the same as that of the third preferred embodiment except for the coupling structure. Therefore, the coupling structure is mainly described in the following description. Please note the corresponding components of the fan units of the present preferred embodiment and the third preferred embodiment are labeled with reference signs with different suffixes. The suffixes correspond to the suffixes of the axial fans.

Referring to FIG. 11, a housing 4I of an upper axial fan 10I is provided with a lower engaging portion 47I adjacent to the lower end surface thereof. The lower engaging portion 47I extends in the circumferential direction of the outer side surface of the cylindrical portion of the housing 4I. The lower engaging portion 47I has a protrusion 471I which protrudes from the outer side surface of the cylindrical portion of the housing 4I away from the center axis J1. The lower engaging portion 47I also has a first lower locking portion 472I and a second lower locking portion 473I on the outer side surface of the protrusion 471I. A portion 4711I of the outer side surface of the protrusion 471I, which is located on the upstream side of the first and second lower locking portions 472I and 473I in the counterclockwise direction, forms a portion of a cylindrical plane centered about the center axis J1. Also, a portion 4712I of the outer side surface of the protrusion 471I, which is located on the downstream side of the first and second lower locking portions 472I and 473I in the counterclockwise direction, forms a portion of a cylindrical plane centered about the center axis J1. The radius of the portion 4712I is larger than that of the portion 4711I in the present preferred embodiment. The axial thickness of the protrusion 471I is preferably thinner than that of the flange 42I. The lower end surface of the protrusion 471I is in the same plane as the lower end surface of the housing 4I. The protrusion 471I extends in the circumferential direction of the cylindrical portion of the housing 4I so that it does not project beyond the outer edge of the flange 42I, and is connected to the flange 42I at the end which is closer to the first lower locking portion 472I than to the second lower locking portion 473I, as shown in FIG. 11. Also, attachment holes 421I, 421J are provided in the flanges 42I, 42J, respectively The first lower locking portion 472I provided on the radially outer surface of the protrusion 471I projects radially outwards. The first lower locking portion 472I includes a contact surface 4721I and a sloping surface 4722I. The sloping surface 4722I gradually extends away from the outer side surface of the cylindrical portion of the housing 4I as it extends in the counterclockwise direction in FIG. 11. The contact surface 472I is arranged at the opposite end thereof to the second lower locking portion 473I, i.e., the downstream end in the counterclockwise direction.

The second lower locking portion 473I provided on the outer side surface of the protrusion 471I projects radially outwards. The second lower locking portion 473I is arranged on the upstream side of the first lower locking portion 472I in the counterclockwise direction in FIG. 11 corresponding to the direction of rotation of the housing 4J described later. That is, the second lower locking portion 473I is arranged on the left of the first lower locking portion 472I in FIG. 11. The outer side surface of the second lower locking portion 473I is continuous with the sloping surface 4722I of the first lower locking portion 472I. In other words, the distance of the outer side surface of the second lower locking portion 473I from the center axis J1 is substantially the same as the minimum distance of the sloping surface 4722I of the first lower locking portion 472I from the center axis J1. The second lower locking portion 473I has a contact surface 4731I at one end opposite to the first lower locking portion 472I.

A housing 4J of the lower axial fan 10J is provided with an upper engaging portion 48J adjacent to the upper end surface thereof. The upper engaging portion 48J projects upward in the axial direction from the upper surface of the flange 42J, as shown in FIG. 11. The upper engaging portion 48J has a base portion 481J projecting axially upward.

On the inner side surface of the base portion 481J are formed at a first upper locking portion 482J and a second upper locking portion 483J arranged on the upstream side of the first upper locking portion 482J in the counterclockwise direction in FIG. 11. Each of the first and second upper locking portions 482J and 483J extends over the entire length of the base portion 481J in the axial direction along the inner side surface of the base portion 481J. Moreover, the upper end of each of the first and second upper locking portions 482J and 483J projects radially inward from the upper end of the base portion 481J. A portion of the radially inner surface of the first upper locking portion 482J located below the upper projection thereof, which is hereinafter referred to as an inner side surface 4823J, forms a portion of a cylindrical plane centered about the center axis J1. Similarly, a portion of the radially inner surface of the second upper locking portion 483J located below the upper projection thereof, which is hereinafter referred to as an inner side surface 4833J, forms a portion of a cylindrical plane centered about the center axis J1. In the present preferred embodiment, the radius of the inner side surface 4823J preferably is approximately the same as that of the outer side surface 4712I of the protrusion 471I, and the radius of the inner side surface 4833J preferably is approximately the same as that of the outer side surface 4711I of the protrusion 471I.

The first and second upper locking portions 482J and 483J have contact surfaces 4821J and 4831J, respectively, which oppose each other. Each of the inner side surfaces 4822J and 4832J of the upper projections of the first and second upper locking portions 482J and 483J defines a portion of a cylindrical plane centered about the center axis J1. The inner side surfaces 4822J and 4832J preferably have approximately the same radius as the outer side surface of the cylindrical portion of the housing 4I.

The axial dimension of the space between the lower end surface of the upper projection of each of the first and second upper locking portions 482J and 483J and the upper end surface 422J of the housing 4J is approximately the same as or slightly smaller than the axial thickness of the protrusion 471I of the housing 4I in the present preferred embodiment.

The coupling of the axial fans 10I and 10J to each other is now described.

First, the axial fans 10I and 10J are arranged coaxially with each other so that the lower end surface of the housing 4I and the upper end surface of the housing 4J are in axial contact with each other, as shown in FIG. 11. In this step, the housing 4J is shifted relative to the housing 4I with the upper engaging portion 48J arranged on the upstream side of the lower engaging portion 47I in the counterclockwise direction in FIG. 11.

Then, the housing 4J is rotated about the center axis J1 relative to the housing 4I in the direction Rd. In the present preferred embodiment, the direction Rd is the counterclockwise direction in FIG. 11. As a result, the lower engaging portion 47I engages with the upper engaging portion 48J, thereby forming the fan unit of the present preferred embodiment.

During the rotation, when the lower end surface of the housing 4I slides on the upper end surface of the housing 4J. The upper engaging portion 48J reaches the lower engaging portion 47I, the protrusion 471I enters the space between the lower end surface of the upper projection of the first upper locking portion 482J and the flange 42J, i.e., the upper end surface of the housing 4J. At the same time, the inner side surface 4823J of the first upper locking portion 482J, which is below the upper projection thereof, comes into contact with the outer side surface 4711I of the protrusion 471I in the radial direction. Thus, the radial movement of the base portion 481J and the protrusion 471I is restricted. The outer side surface 4711I of the protrusion 471I guides the upper engaging portion 48J so that the upper engaging portion 48J moves along the direction Rd.

When the housing 4J is rotated further, the first upper locking portion 482J passes outside the second lower locking portion 473I in the radial direction.

Then, the inner side surface 4823J of the first upper locking portion 482J, which is below the upper projection thereof, reaches the sloping surface 4722I of the second lower locking portion 472I. While passing by the sloping surface 4722I, the first upper locking portion 482J is elastically deformed radially outwards, i.e., in a direction away from the center axis J1 by the sloping surface 4722I.

When the housing 4J is rotated further, the protrusion 471I enters into the space between the lower end surface of the upper projection of the second upper locking portion 483J and the flange 42J, i.e., the upper end surface of the housing 4J. In this space, the axial movement of the protrusion 471I is restricted by the second upper locking portion 483J and the flange 42J. As the housing 4J is rotated further, the contact surface 4831J of the second upper locking portion 483J comes into contact with the contact surface 4731I of the second lower locking portion 473I in the direction Rd. At this time, the first upper locking portion 482J is located radially outside the outer side surface 4722I of the first lower locking portion 472I.

When the housing 4J is further rotated while the contact surface 4831J of the second upper locking portion 483J is in contact with the contact surface 4731I of the second lower locking portion 473I, the first upper locking portion 482J is forced to move forward of the outer side surface 4722I of the second lower locking portion 472I in the direction Rd with the second upper locking portion 483J elastically deformed. Consequently, the radially outward deformation of the first upper locking portion 482J is released and the inner end surface of the upper projection of the first upper locking portion 482J comes into contact with the outer side surface of the cylindrical portion of the housing 4I.

Subsequently, the second upper locking portion 483J which is elastically deformed pulls the first upper locking portion 482J toward the opposite direction to the direction Rd. At this time, the contact surface 4821J of the first upper locking portion 482J comes into contact with the contact surface 4721I of the first lower locking portion 472I in the direction Rd. The distance between the contact surface 4821J of the first upper locking portion 482J and the contact surface 4831J of the second upper locking portion 483J in the direction Rd is smaller than the distance between the contact surface 4721I of the first lower locking portion 472I and the contact surface 4731I of the second lower locking portion 473I in the direction Rd in the present preferred embodiment. Therefore, the first and second upper locking portions 482J and 483J are pressed toward the rotating direction Rd and the direction opposite thereto by the first and second upper locking portions 472I and 473I. Therefore, further rotation of the housing 4J relative to the housing 4I about the center axis J1 is prevented. Also, the coupling of the housings 4I and 4J have no play.

In addition, the protrusion 471I is axially sandwiched between a portion of the upper engaging portion 48J and the upper end surface of the housing 4D while being pressed from both axial sides (i.e., in two axial directions) to cause elastic axial deformation of the protrusion 471I. Therefore, the axial movement of the housings 4I and 4J is also prevented.

In the above description, the preferred embodiments of the present invention are described. However, the present invention is not limited thereto but can be modified in various ways. For example, exemplary combinations of the first upper locking portion, the second upper locking portion, the first lower locking portion, and the second lower locking portion are described in the preferred embodiments. However, the present invention is not limited thereto. Any combination of the upper and lower locking portions can be used in the present invention.

Moreover, only the fan units including two axial fans are described in the aforementioned preferred embodiments. However, the number of the coupled axial fans is not limited two. For example, three or more axial fans can be coupled to one another with any of the aforementioned coupling structures.

The material of the housings, for example, may be any of various resin or plastic or a die-cast aluminum material. Also, the protrusions and the notches may take any arbitrary shape as required.

Further, the cylindrical portions are not required to have a completely cylindrical inner side surface, but may have a venturi-shaped inner side surface with the diameter changing in the direction along the rotational axis of the impeller, or a wide tapered opening.

Also, the rotational axis of the impeller and the center axis of the housing are not required to coincide with each other but may be displaced from each other.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A housing assembly for use in a fan unit, the housing assembly comprising:

an upper housing and a lower housing coaxially coupled to each other to define a substantially cylindrical space for accommodating a plurality of blades therein; wherein the upper housing has a lower end surface and a lower engaging portion adjacent thereto, and the lower housing has an upper end surface and an upper engaging portion adjacent thereto;

the lower and upper engaging portions are arranged to engage each other to couple the upper and lower housings to each other by rotating one of the upper and lower housings about a center axis of the upper and lower housings relative to the other in a first direction with the lower end surface of the upper housing in axial contact with the upper end surface of the lower housing; and when the lower and upper engaging portions are in engagement, one of the lower and upper engaging portions presses the other lower and upper engaging portion in two axial directions to cause elastic axial deformation of the other lower and upper engaging portion, and one of the lower and upper engaging portions presses the other lower and upper engaging portion in both the first direction and a second direction opposite thereto to cause elastic circumferential deformation of the other lower and upper engaging portion.

2. The housing assembly according to claim 1, wherein the upper engaging portion includes a first upper locking portion and a second upper locking portion, and the lower engaging portion includes a first lower locking portion and a second lower locking portion;

the first lower locking portion presses the first upper locking portion in the first direction; and the second lower locking portion presses the second upper locking portion in the second direction.

3. The housing assembly unit according to claim 2, wherein, before the lower and upper engaging portions engage each other, a distance between the first lower locking portion and the second lower locking portion of the lower engaging portion is larger than a distance between the first upper locking portion and the second upper locking portion of the upper engaging portion in the first direction.

4. The housing assembly according to claim 2, wherein the upper housing includes a substantially cylindrical portion arranged about the center axis, and the lower engaging portion includes a protrusion protruding from the substantially cylindrical portion away from the center axis; and when the lower and upper engaging portions are in engagement, the protrusion is arranged between at least one of the first upper locking portion and the second upper locking portion and the upper end surface of the lower housing, and is pressed from two axial directions by the at least one of the first upper locking portion and the second upper locking portion and the upper end surface of the lower housing.

5. The housing assembly according to claim 4, wherein the first lower locking portion is arranged on the protrusion, and at least a portion of an upper surface of the first lower locking portion includes a sloping surface sloping upward in the first direction to a contact surface which contacts with the first upper locking portion when the lower and upper engaging portions are in engagement.

6. The housing assembly according to claim 5, wherein, while the lower housing is rotated about the center axis relative to the upper housing, the first upper locking portion is elastically deformed axially upward by the sloping surface of the first lower locking portion; and after the first upper locking portion passes over the sloping surface, elastic deformation of the first upper locking portion is released and the first upper locking portion engages with the first lower locking portion.

7. The housing assembly according to claim 4, wherein the first lower locking portion is arranged on an upper surface or an outer side surface of the protrusion; and at least a portion of an outer side surface of the first lower locking portion includes a sloping surface which slopes away from the upper surface or the outer side surface of the protrusion in the first direction.

8. The housing assembly according to claim 7, wherein, while the lower housing is rotated about the center axis relative to the upper housing, the first upper locking portion is elastically deformed in a direction away from the center axis by the sloping surface of the first lower locking portion; and after the first upper locking portion passes over the sloping surface, elastic deformation is released and the first upper locking portion engages with the first lower locking portion.

9. The housing assembly according to claim 2, wherein, during rotation of the lower housing relative to the upper housing, the first upper locking portion engages with the first lower locking portion after the first upper locking portion passes over the second lower locking portion and the second upper locking portion and the second lower locking portion engage with each other.

10. The housing assembly according to claim 2, wherein the upper engaging portion includes a guiding portion arranged to guide the lower engaging portion along the first direction.

11. The housing assembly according to claim 10, wherein the upper housing includes a substantially cylindrical portion arranged about the center axis, and the lower engaging portion includes a protrusion protruding away from the cylindrical portion of the upper housing; and an outer side surface of the protrusion is arranged to guide the upper engaging portion of the lower housing by coming into contact with the upper engaging portion.

12. The housing assembly according to claim 1, wherein the housing assembly is approximately rectangular when viewed along the center axis; and the lower engaging portion and the upper engaging portion are arranged at each corner to axially align with each other.

13. A fan unit comprising:

the housing assembly according to claim 1;

multiple sets of blades arranged inside the housing assembly, each set of blades being arranged about the center axis; and multiple motors each provided to rotate a corresponding one of the sets of blades about the center axis.

* * * * *